US010612537B2

(12) United States Patent
Hodges et al.

(10) Patent No.: US 10,612,537 B2
(45) Date of Patent: Apr. 7, 2020

(54) HYDRAULIC OIL WELL PUMPING SYSTEM, AND METHOD FOR PUMPING HYDROCARBON FLUIDS FROM A WELLBORE

(71) Applicant: Hydraulic Rod Pumps, International, Foothill Ranch, CA (US)

(72) Inventors: Christopher M. Hodges, Ladera Ranch, CA (US); Lance A. Mehegan, Valencia, CA (US); Timothy L. Hankerd, Corona, CA (US); Nathan Terry, Lake Forest, CA (US); Walter Phillips, HUntington Beach, CA (US)

(73) Assignee: Hydraulic Rod Pumps, International, Foothill Ranch, CA (US)

( * ) Notice: Subject to any disclaimer, the term of this patent is extended or adjusted under 35 U.S.C. 154(b) by 594 days.

(21) Appl. No.: 15/013,210

(22) Filed: Feb. 2, 2016

(65) Prior Publication Data

US 2016/0177683 A1 Jun. 23, 2016

Related U.S. Application Data

(62) Division of application No. 14/023,229, filed on Sep. 10, 2013.

(Continued)

(51) Int. Cl.
*F04B 47/04* (2006.01)
*F04B 17/05* (2006.01)
(Continued)

(52) U.S. Cl.
CPC ..... *F04B 47/04* (2013.01); *E21B 43/121* (2013.01); *E21B 43/126* (2013.01);
(Continued)

(58) Field of Classification Search
CPC ..... F04B 9/107–1073; F04B 47/04; F04B 47/145; F04B 49/06–065; F04B 49/106;
(Continued)

(56) References Cited

U.S. PATENT DOCUMENTS 4,480,685 A * 11/1984 Gilbertson ..... F04B 47/04 166/68.5
4,848,085 A * 7/1989 Rosman ..... E21B 43/127 60/372

(Continued)

*Primary Examiner* — Alexander B Comley
(74) *Attorney, Agent, or Firm* — Peter Brewer; Thrive IP

(57) ABSTRACT

A hydraulic oil well pumping system is provided. The system uses a pump to exert hydraulic pressure against a reciprocating piston over a wellbore. The piston is connected to a rod string and downhole pump for pumping oil from a wellbore. The system includes an electronic control system that controls movement of the piston as it moves between the upper and lower rod positions by cycling the hydraulic system between (i) an "upstroke" condition wherein the pump is pumping oil through the oil line into the hydraulic cylinder to move the piston to its upper rod position, and (ii) a "neutral" condition wherein the pump is no longer pumping oil into the hydraulic cylinder, but is allowing oil to flow back through the oil line in response to gravitational fall of the piston. The control system is programmed to cycle based upon a volumetric calculation of hydraulic oil in the cylinder without reference to position sensors along the wellhead. Wellhead conditions or placement of the hydraulic cylinder inside the wellbore may prohibit attaching physical sensors at the wellhead. A method for pumping oil from a wellbore using such a system is also provided herein.

12 Claims, 11 Drawing Sheets

Related U.S. Application Data

(60) Provisional application No. 61/701,064, filed on Sep. 14, 2012.

(51) Int. Cl.

| | |
|---|---|
| ***E21B 43/12*** | (2006.01) |
| ***F04B 9/107*** | (2006.01) |
| ***F04B 23/02*** | (2006.01) |
| ***F04B 49/10*** | (2006.01) |
| ***F04B 49/20*** | (2006.01) |
| ***F04B 49/08*** | (2006.01) |
| ***F04B 49/06*** | (2006.01) |
| ***F04B 49/22*** | (2006.01) |
| ***F04B 19/22*** | (2006.01) |
| ***F04B 47/02*** | (2006.01) |
| ***F04B 49/00*** | (2006.01) |

(52) U.S. Cl.
CPC ..... *E21B 43/129* (2013.01); *F04B 9/1073* (2013.01); *F04B 17/05* (2013.01); *F04B 23/02* (2013.01); *F04B 23/023* (2013.01); *F04B 49/065* (2013.01); *F04B 49/08* (2013.01); *F04B 49/106* (2013.01); *F04B 49/20* (2013.01); *F04B 49/22* (2013.01); *F04B 9/107* (2013.01); *F04B 19/22* (2013.01); *F04B 47/026* (2013.01); *F04B 49/002* (2013.01)

(58) Field of Classification Search
CPC ..... F04B 2205/09; F04B 9/103; F04B 17/03; F04B 17/05; F04B 35/04; F04B 41/02; F04B 47/02; F04B 49/002; F04B 49/022; F04B 49/08; F04B 49/20–22; E21B 43/121; E21B 43/126; E21B 43/129
USPC ..... 166/68, 68.5, 105
See application file for complete search history.

(56) References Cited

U.S. PATENT DOCUMENTS

| | | | | |
|---|---|---|---|---|
| 5,832,727 A * | 11/1998 | Stanley | F04B 9/105 | 60/372 |
| 6,269,641 B1 * | 8/2001 | Dean | E21B 23/04 | 166/344 |
| 8,851,860 B1 * | 10/2014 | Mail | F04B 47/02 | 166/105 |
| 2012/0247785 A1 * | 10/2012 | Schmitt | E21B 43/121 | 166/372 |

* cited by examiner

HYDRAULIC OIL WELL PUMPING SYSTEM, AND METHOD FOR PUMPING HYDROCARBON FLUIDS FROM A WELLBORE

CROSS REFERENCE TO RELATED APPLICATIONS

This application claims the benefit of U.S. Application No. 61/701,064, dated Sep. 14, 2012.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

BACKGROUND OF THE INVENTION

This section is intended to introduce various aspects of the art, which may be associated with exemplary embodiments of the present disclosure. This discussion is believed to assist in providing a framework to facilitate a better understanding of particular aspects of the present disclosure. Accordingly, it should be understood that this section should be read in this light, and not necessarily as admissions of prior art.

Field of the Invention

The present disclosure relates to the field of hydrocarbon recovery operations. More specifically, the present invention relates to hydraulically actuated pumping units for the production of hydrocarbon fluids and for dewatering gas wells.

Technology in the Field of the Invention

In the drilling of oil and gas wells, a wellbore is formed using a drill bit that is urged downwardly at a lower end of a drill string. After drilling to a predetermined depth, the drill string and bit are removed and the wellbore is lined with a string of casing. An annular area is thus formed between the string of casing and the surrounding formations.

To prepare the wellbore for the production of hydrocarbon fluids, a string of tubing is run into the casing. A packer is set at a lower end of the tubing to seal an annular area formed between the tubing and the surrounding strings of casing. The tubing then becomes a string of production pipe through which hydrocarbon fluids may be lifted.

In order to carry the hydrocarbon fluids to the surface, a pump may be placed at a lower end of the production tubing. This is known as "artificial lift." In some cases, the pump may be an electrical submersible pump, or ESP. ESP's utilize a hermetically sealed motor that drives a multi-stage pump. More conventionally, oil wells undergoing artificial lift use a downhole reciprocating plunger-type of pump. The reciprocating downhole pump is relatively long and thin to avoid restricting oil flow up the well. The pump has one or more valves that capture fluid on a down stroke, and then lift the fluid on the upstroke. This is known as "positive displacement." In some designs such as that disclosed in U.S. Pat. No. 7,445,435, the pump may be able to both capture fluid and lift fluid on each of the down stroke and the upstroke.

Conventional positive displacement pumps have a barrel that is reciprocated at the end of a "rod string." The rod string comprises a series of long, thin joints of pipe that are threadedly connected through couplings. The rod string is pivotally attached to a pumping unit at the surface. The rod string moves up and down within the production tubing to incrementally lift production fluids from subsurface intervals to the surface.

Most pumping units on land are so-called rocking beam drive units. Rocking beam units typically employ electric motors or internal combustion engines having a rotating drive shaft. The shaft turns a crank arm, or possibly a pair of crank arms. The crank arms, in turn, have heavy, counterweighted flywheels. The flywheels rotate along with the crank arms. Rocking beam units also have a walking beam. The walking beam pivots over a fulcrum. One end of the walking beam is mechanically connected to the crank arms. As the crank arms and flywheels rotate, they cause the walking beam to reciprocate up and down over the fulcrum.

The opposite end of the walking beam is a so-called horse head. The horse head is positioned over the well head at the surface. As the walking beam is reciprocated, the horse head cycles up and down over the wellbore. This, in turn, translates the rod and attached pump up and down within the wellbore. A drawing and further description of a walking beam unit are provided in U.S. Pat. No. 7,500,390, which is incorporated herein in its entirety by reference.

Another type of pumping unit is a hydraulic actuator system. These systems employ a cylinder residing over a wellbore. The cylinder is axially aligned with the wellbore and holds a reciprocating piston. The cylinder cyclically receives fluid pressure through an oil line. As fluid is injected through the oil line and into the cylinder, the piston is caused to move linearly within the cylinder. This, in turn raises the connected rod string, causing the pump to undergo an upstroke. When fluid pressure is released from the cylinder, the rod string is lowered due to gravitational forces, causing the downhole pump to undergo a downstroke.

Surface hydraulic actuator systems have been used successfully for many years. Such systems offer a beneficially long stroke length for the downhole plunger pump. Such systems are also ideal for urban environments where a small footprint is demanded. Further, such systems offer the ability to operate more than one well from a single surface installation.

During operation of any rod pump system for a producing well, it is desirable to be able to monitor the position of the rod string and specifically, the piston within the cylinder. In this respect, it is helpful to know when the piston is about to reach a top or bottom of a stroke. Knowing this position allows the operator to slow or stop the motion of the piston and rod-string pro-actively, eliminating the "slamming" of the piston against a plate within the cylinder.

Further, it is desirable to be able to measure the load on the sucker rods making up the rod string. The load can be recorded and printed out on a so-called surface dynamometer card. The "dyno card" offers a plot of the measured rod loads at various positions throughout a complete stroke. The load is usually displayed in pounds of force, while the position is usually displayed in inches. The pump dynamometer card represents the load the pump applies to the bottom of the rod string. Dynamometer cards are displayed by predictive and diagnostic software for the purposes of design and diagnosing sucker rod pumping systems.

Historically, hydraulic pressure has been used to measure rod loads for dynamometer cards. Then, separate physical measurements have been made on the piston and polished rod for determining position. This requires the use of sensors at the wellhead to directly measure piston position. Such sensors may be either discrete position switches or more advanced linear position sensors. SPE Paper No. 113186 entitled "Optimizing Downhole Fluid Production of Sucker-Rod Pumps With Variable Speed Motor" (2009) describes some of the mathematics behind the dynagraph calculations, and is incorporated herein by reference in its entirety.

A need exists to be able to use the hydraulic fluid data to determine not only the load on the rod string, but also the position of the piston using only the hydraulic fluid as the measurement for both position and load without the need for data gathered from devices or sensors at or near the wellhead. Removal of electronic or other methods of directly attached instrumentation from areas around the wellhead reduces risk of sparking and also eliminates the cost of placing and maintaining such instrumentation. Further, it is desirable to be able to determine the position of the piston within the cylinder on both the upstroke and the down stroke at a safe distance without using position sensors at the wellhead.

BRIEF SUMMARY OF THE INVENTION

An oil well pumping system is first provided herein. The pumping system uses a set of valves and an electrical control system to cyclically direct hydraulic fluid into and release hydraulic fluid from a cylinder. The pressure created by the hydraulic fluid causes a piston and connected rod string and downhole pump to reciprocate. This, in turn, causes reservoir fluids to be produced from a wellbore to the surface through positive displacement.

In one aspect, the oil well pumping system first includes an elongated hydraulic cylinder. The cylinder is positioned over the wellbore. The cylinder may either be over an associated wellhead, or inside the wellbore and below the wellhead.

The hydraulic cylinder may be placed above the wellhead, where sensors are easily attached, but the cylinder may also be placed inside the wellbore. This aspect places the entirety of the hydraulic cylinder length within the wellbore, below the wellhead. Because the length of the cylinder is inaccessible, it is impossible to place sensors along the cylinder in this configuration. The need exists for an alternate method of determining position without the use of direct instrumentation of the hydraulic cylinder when positioned entirely in the wellbore and submerged in crude oil.

The oil well pumping system also includes a piston and a polished rod. The polished rod defines an elongated rod that is movable with the piston between upper and lower rod positions within the cylinder. The piston, in turn, provides an annular seal between the polished rod and the surrounding cylinder. Hydraulic pressure cyclically acts against the piston to create an upstroke and a down stroke of the polished rod.

The oil well pumping system further has a rod string. The rod string is mechanically connected to the lower end of the polished rod. This means that when the piston reciprocates, the rod string reciprocates with it. The rod string extends downwardly from the polished rod and into the wellbore. The rod string has a downhole pump connected to it for lifting fluids to the surface in response to reciprocation of the rod string.

The oil well pumping system also includes a hydraulic pump. The pump is powered by a prime mover. The prime mover may be an electric motor, an internal combustion engine, or other driver.

The oil well pumping system further includes a directional control valve. The directional control valve shifts between upstroke and downstroke flow positions. When the valve is in its upstroke position, it directs hydraulic fluid such as oil from the pump and into the annular area formed below the piston between the polished rod and the surrounding cylinder. When the directional control valve is in its downstroke (or neutral) position, it receives reverse flow from the annular area and allows the gravity-induced fall of the piston and connected rod string.

The oil well pumping system also has an oil line. The oil line connects the pump and the hydraulic cylinder. The control valve is positioned in the oil line so that it can control flow between the pump and the cylinder in response to electrical signals. The signals are sent by an electrical control system that shifts the directional control valve between its upstroke and downstroke flow positions.

A fluid reservoir is also provided. The fluid reservoir contains hydraulic fluid to be supplied to the pump.

The oil well pumping system next comprises a reservoir line. The reservoir line transmits hydraulic fluid from the cylinder back to the reservoir. Optionally, a filter is provided along the reservoir line to filter the return oil. Optionally, a pressure bypass line is also provided to bypass the filter as part of the reservoir or return line.

The oil well pumping system also includes a downstroke control valve. The downstroke control valve has a restricted orifice that chokes the flow of fluid from the cylinder back to the reservoir. The downstroke control valve limits the speed with which the piston and operatively connected rod string fall within the cylinder during the down stroke. This serves to control the rate of flow of hydraulic fluid returning from the cylinder.

As noted, an electronic control system is also provided for the oil well pumping system. The control system controls movement of the piston as it moves between the upper and lower rod positions. This is done by cycling the directional control valve between (i) an "upstroke" condition wherein the pump is pumping oil through the oil line into the hydraulic cylinder to move the piston to its upper rod position, and (ii) a "neutral" condition wherein the pump is no longer pumping oil into the hydraulic cylinder, but is allowing oil to flow back through the oil line in response to gravitational fall of the piston and connected rod string. The electronic control system is programmed to cycle based upon a volumetric capacity of the hydraulic cylinder and the volume of oil delivered to the cylinder, and without reference to position sensors along the wellhead.

In one aspect, the electronic control system controls movement of the piston and polished rod based on time. This may be based on (i) time for the "upstroke" pump condition, (ii) time for the "neutral" pump condition, or (iii) both. In this embodiment, the control system is simply a clock for turning the pump on and off at calculated or estimated time intervals.

In another aspect, the electronic control system controls movement of the piston based on volume. The volume may be (i) the volume of hydraulic fluid sent to the cylinder during the "upstroke" valve condition, (ii) the volume of fluid returned from the cylinder during the "neutral" valve condition, or (iii) both. Note that flow rate and volume are intimately associated. Flow rate is the volume of fluid which passes through a given point in a system per unit time. Flow rate can be calculated as the product of a given cross sectional area for flow and an average flow velocity. A series of flow rate measurements over a cross sectional area taken over a period of time may be used to determine fluid volume passing through the cross section over the time period. Accordingly, direct measurements of total volume and a series of instantaneous measurements of flow rate over time provide equivalent volume information.

A method of pumping oil from a wellbore is also provided herein. The wellbore has a bore extending into an earth surface. The method employs a unique pumping system that uses a set of valves and an electrical control system. The valves cyclically direct hydraulic fluid into a cylinder. The pressure created by the hydraulic fluid causes the piston and a connected rod string and downhole pump to reciprocate. This, in turn, causes reservoir fluids to be produced from a wellbore to the surface through positive displacement.

In one aspect, the method first comprises providing an elongated hydraulic cylinder. The cylinder is positioned over the wellbore. The cylinder may either be over an associated wellhead, or inside the wellbore and below the wellhead.

The method also includes providing a piston and a polished rod. The piston and connected polished rod are movable between upper and lower rod positions within the cylinder. The piston creates an annular seal above the polished rod and the surrounding cylinder. Hydraulic pressure cyclically acts against the piston to create an upstroke and a downstroke.

The method further includes mechanically connecting the piston and polished rod to a rod string. This means that when the piston reciprocates, the rod string reciprocates with it. The rod string extends downwardly from the piston and into the wellbore. The rod string has a downhole pump connected to it for lifting fluids to the surface in response to reciprocation of the rod string.

The method also includes providing a hydraulic pump. In one aspect, the pump is a positive displacement pump. The pump is powered by a prime mover. The prime mover may be an electric motor, an internal combustion engine, or other driver.

The method also has the step of connecting the pump and the hydraulic cylinder with an oil line. The oil line transmits hydraulic fluid from the pump to the cylinder.

Still further, the method includes providing a directional control valve that moves between open upstroke and downstroke flow positions. When the valve is in its upstroke flow position, it directs hydraulic fluid such as oil from the pump, through the oil line and into the annular area formed between the polished rod and the surrounding hydraulic cylinder below the piston. When the valve is in its downstroke flow position, it allows hydraulic fluid to bleed from the cylinder.

The method also has the step of providing a fluid reservoir. The reservoir contains hydraulic fluid to be supplied to the pump.

The method next includes providing a reservoir line. The reservoir line transmits hydraulic fluid from the cylinder back to the reservoir. Optionally, a filter is provided along the reservoir line. It is understood that the term "reservoir line" may mean more than one line, such as a pressure bypass line.

The method also has the step of providing a down stroke control valve. The down stroke control valve chokes the flow of fluid from the cylinder back to the reservoir. This, in turn, limits the rate of flow of hydraulic fluid during the down stroke of the piston.

The method also offers the step of controlling movement of the piston as it moves between upper and lower rod positions. This is done by using an electronic control system. The control system controls the valves and the pump to cycle the pump between (i) an "upstroke" condition wherein the pump is pumping oil through the directional control valve, through the oil line and into the hydraulic cylinder to move the piston to its upper rod position, and (ii) a "neutral" condition wherein the pump is no longer pumping oil into the hydraulic cylinder, but is allowing oil to flow back through the oil line and the down stroke control valve in response to gravitational fall of the piston and connected polished rod. The electronic control system is programmed to cycle based upon a volumetric calculation of the capacity of the hydraulic cylinder and the oil delivered to, or received back from, the cylinder without reference to position sensors located in the wellhead environment.

Preferably, the electronic control system controls movement of the piston based on volume. The volume may be (i) the volume of hydraulic fluid sent to the cylinder during the "upstroke" pump condition, (ii) the volume of fluid returned from the cylinder during the "neutral" pump condition, or (iii) both. In another aspect, the electronic control system controls movement of the rod based on (i) time for the "upstroke" valve condition, (ii) time for the "neutral" valve condition, or (iii) both. Time on the downstroke or "neutral" pump condition may be limited, as the next upstroke may take place at a fixed interval.

Optionally, the control system may send a signal to cause the pump to vary its output, to cause a valve to adjust its proportional flow, or to change an operating speed of the prime mover based upon either (i) a relative volume of fluid that has moved into the hydraulic cylinder, or (ii) an absolute volume of fluid that has moved into the hydraulic cylinder, during the "on" pump condition.

Also, the method includes reciprocating the piston and mechanically connected rod string in order to pump oil from the wellbore.

BRIEF DESCRIPTION OF THE DRAWINGS

So that the manner in which the present inventions can be better understood, certain illustrations, charts and/or flow charts are appended hereto. It is to be noted, however, that the drawings illustrate only selected embodiments of the inventions and are therefore not to be considered limiting of scope, for the inventions may admit to other equally effective embodiments and applications.

Figure 4A:
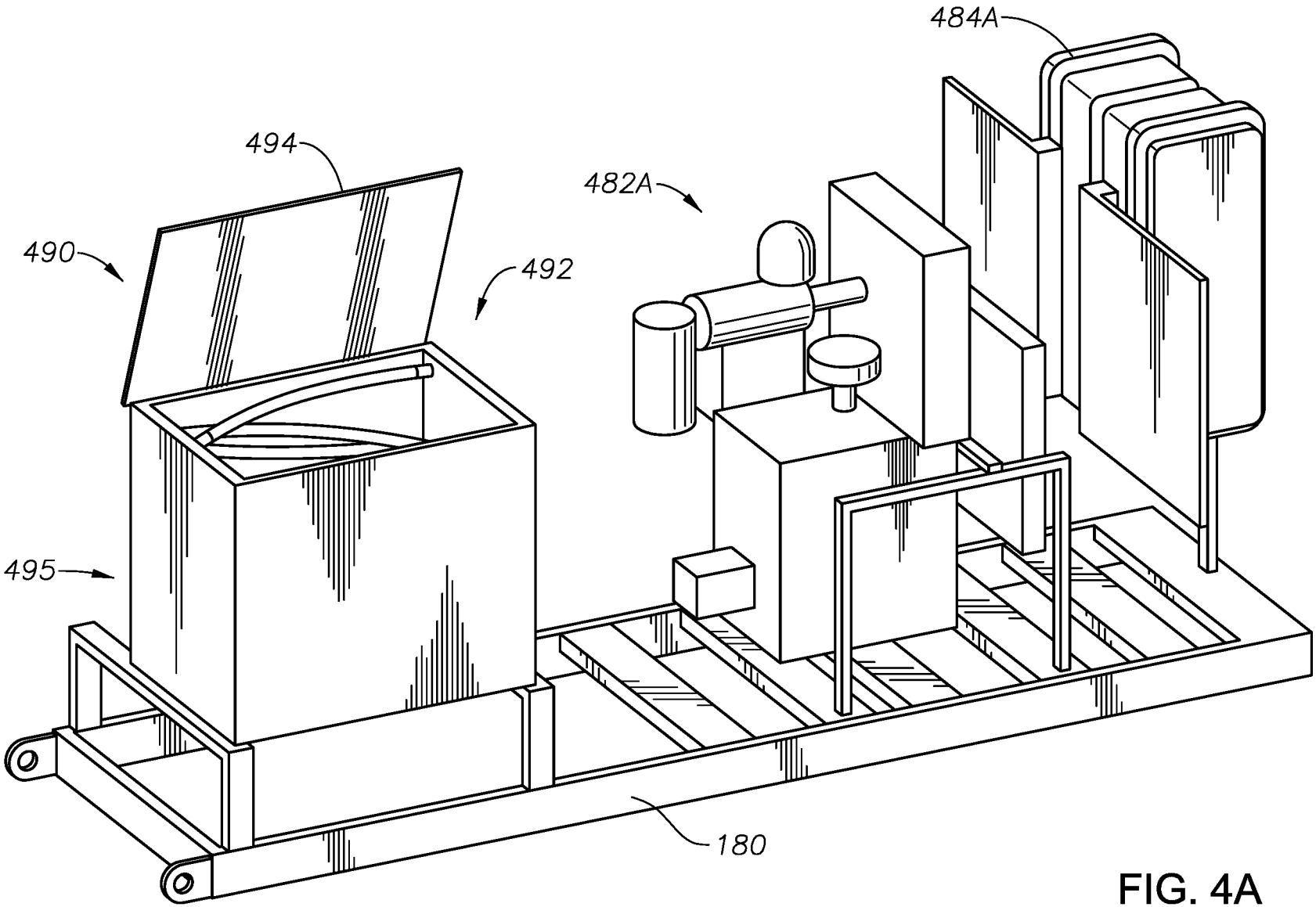
FIG. 4A is a perspective view of a skid having certain components of the hydraulic oil well pumping system of FIG. 1. An internal combustion engine is shown as the prime mover for powering a hydraulic pump.
Figure 4B:
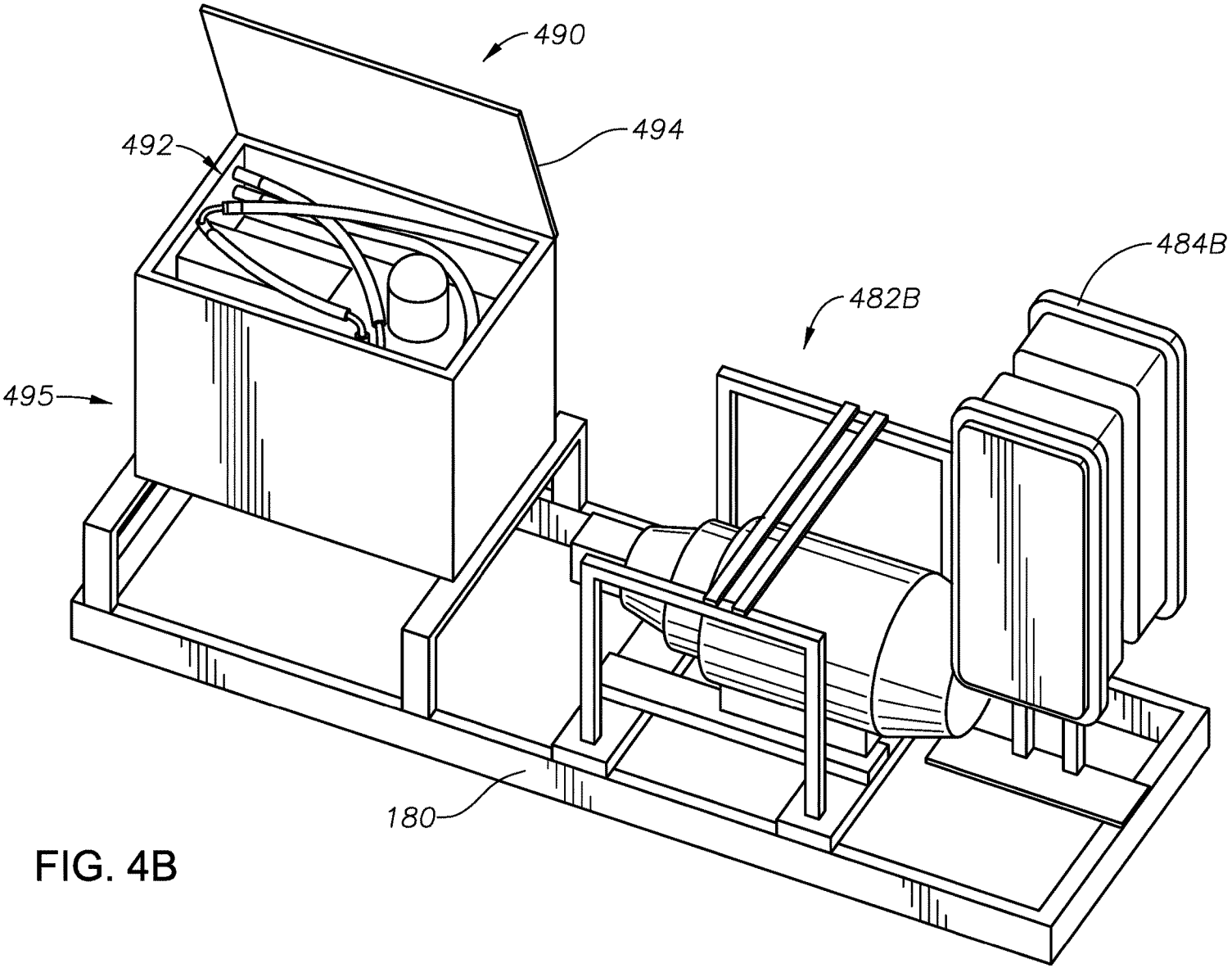
FIG. 4B is a perspective view of a skid having components of the hydraulic oil well pumping system of FIG. 1, in an alternate embodiment. Here, an electric motor is shown as the prime mover for powering a hydraulic pump.

In each of FIGS. 4A and 4B, a novel two-chambered tank is provided. Valves and hoses are housed in an upper chamber, while working oil is housed in a lower chamber.

Figure 5:
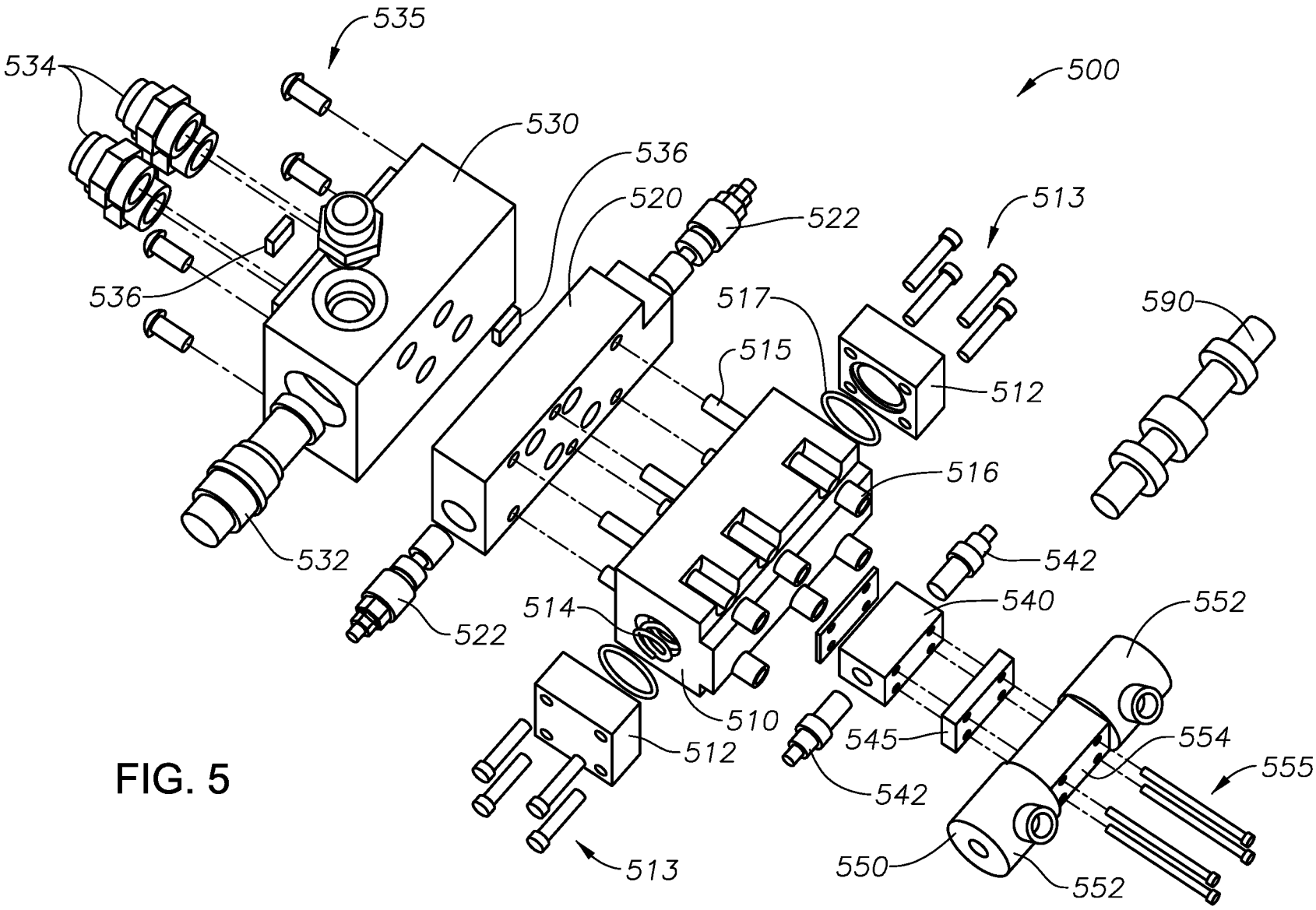

FIG. 5 is an exploded perspective view of the valve stack from FIGS. 4A and 4B. This valve stack includes a directional control valve and a downstroke control valve.

Figure 6:
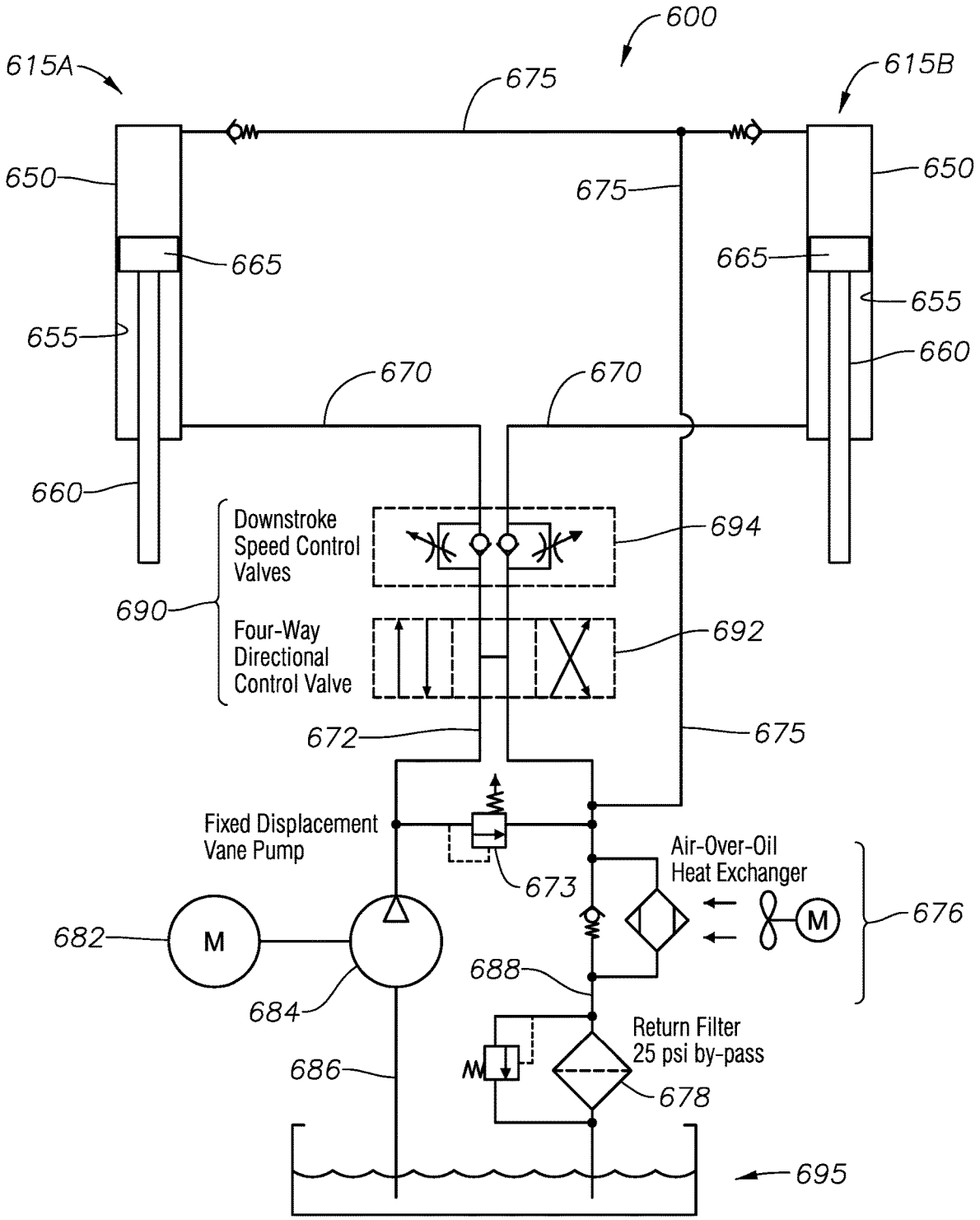

FIG. 6 is an engineering diagram showing illustrative hydraulic circuitry of the hydraulic oil well pumping system of FIG. 1, in one embodiment. Fluid lines and certain components for the system are shown schematically.

Figure 7:
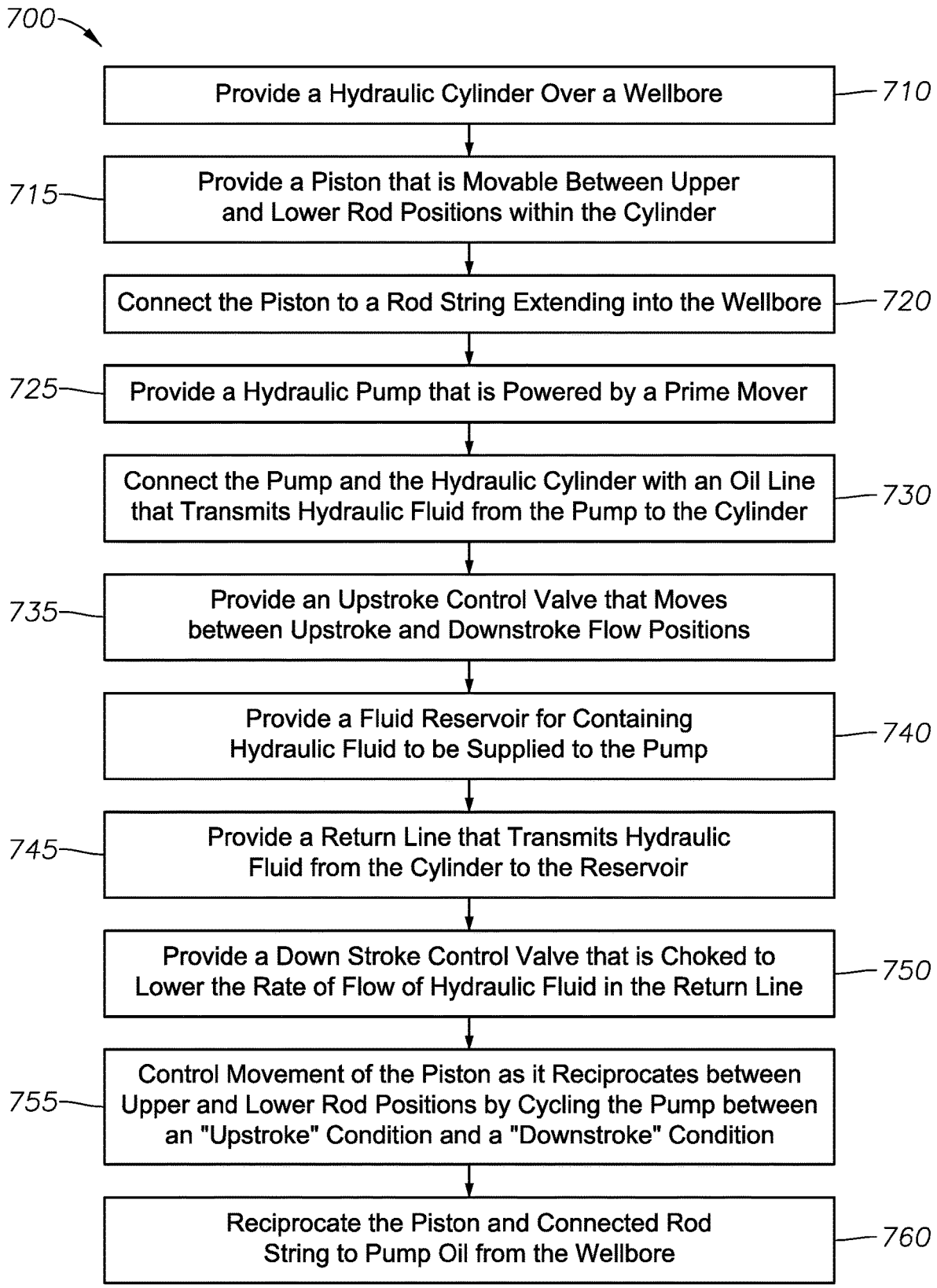

FIG. 7 is a flow chart showing steps that may be performed for a method of pumping oil from an oil well, in one embodiment.

Figure 8A:
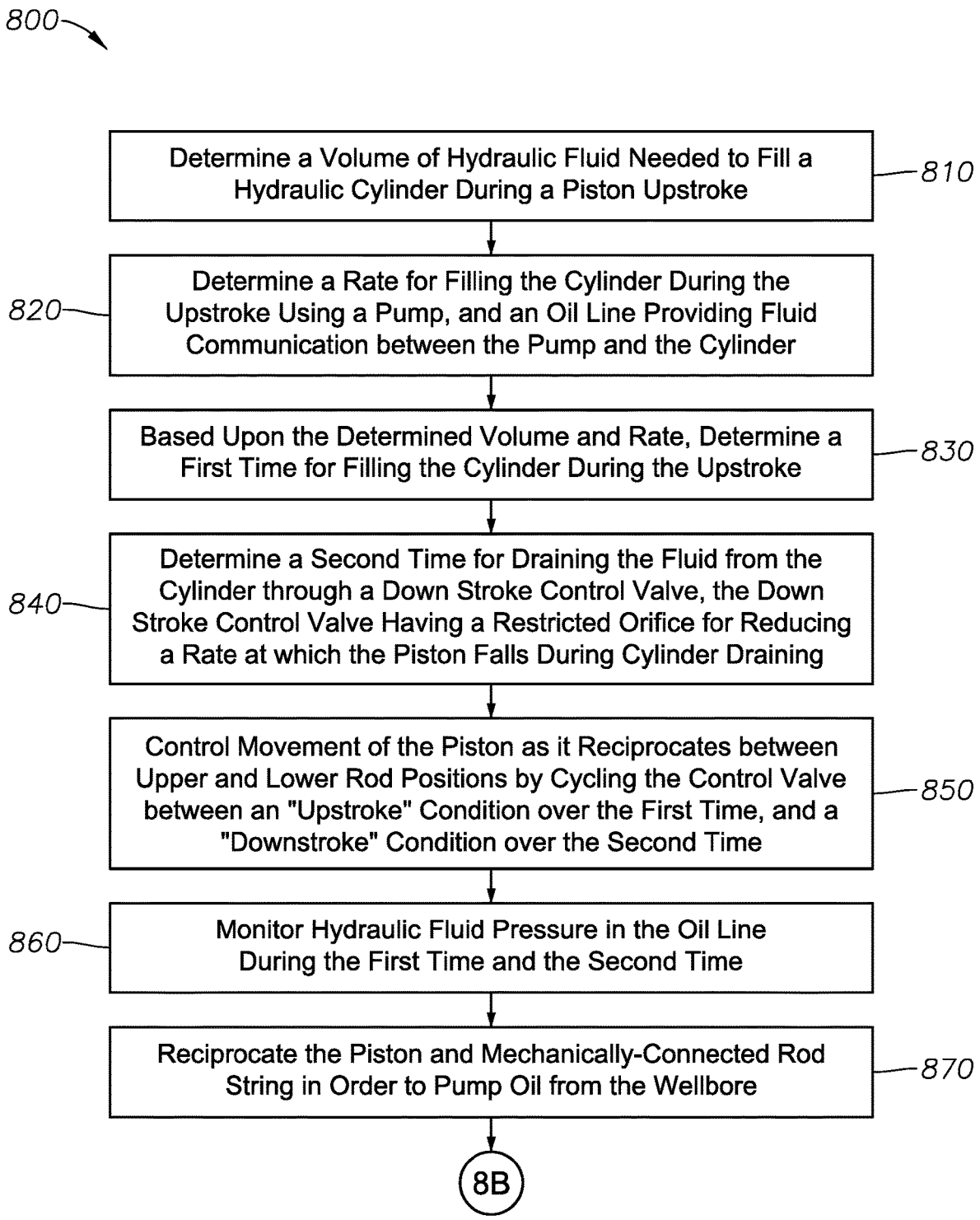
Figure 8B:
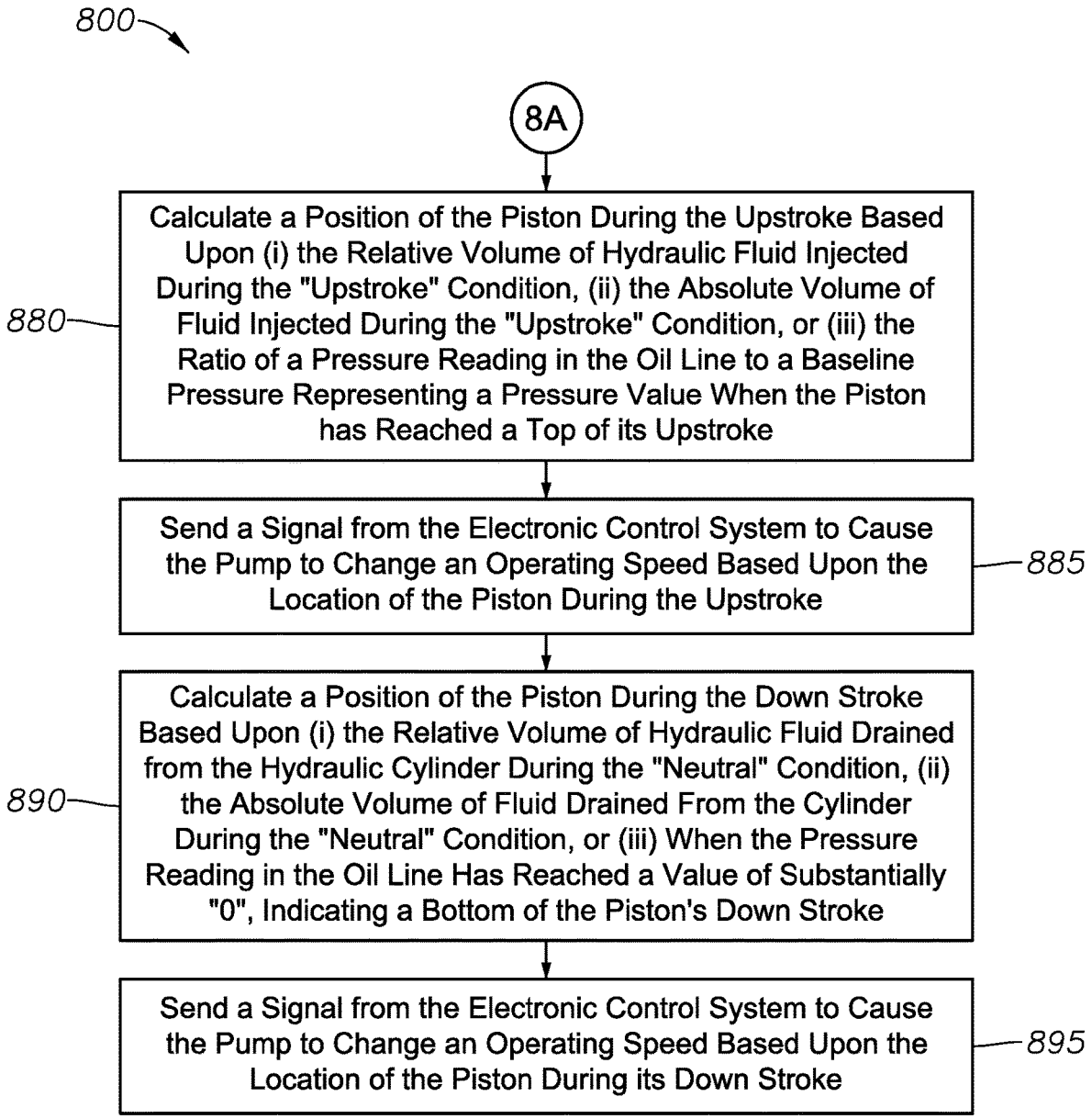

FIG. 8A and FIG. 8B are another flow chart. Here, steps are shown for a method of determining the position of a hydraulically actuated piston within a cylinder.

DETAILED DESCRIPTION OF CERTAIN EMBODIMENTS

Definitions

For purposes of the present application, it will be understood that the term "hydrocarbon" refers to an organic compound that includes primarily, if not exclusively, the elements hydrogen and carbon. Hydrocarbons may also include other elements, such as, but not limited to, halogens, metallic elements, nitrogen, oxygen, and/or sulfur. Hydrocarbons generally fall into two classes: aliphatic, or straight chain hydrocarbons, and cyclic, or closed ring hydrocarbons, including cyclic terpenes. Examples of hydrocarbon-containing materials include any form of natural gas, oil, coal, and bitumen that can be used as a fuel or upgraded into a fuel.

As used herein, the term "hydrocarbon fluids" refers to a hydrocarbon or mixtures of hydrocarbons that are gases or liquids. For example, hydrocarbon fluids may include a hydrocarbon or mixtures of hydrocarbons that are gases or liquids at formation conditions, at processing conditions or at ambient conditions (15° C. and 1 atm pressure). Hydrocarbon fluids may include, for example, oil, natural gas, coalbed methane, shale oil, pyrolysis oil, pyrolysis gas, a pyrolysis product of coal, and other hydrocarbons that are in a gaseous or liquid state.

As used herein, the terms "produced fluids," "reservoir fluids" and "production fluids" refer to liquids and/or gases removed from a subsurface formation, including, for example, an organic-rich rock formation. Produced fluids may include both hydrocarbon fluids and non-hydrocarbon fluids. Production fluids may include, but are not limited to, oil, natural gas, pyrolyzed shale oil, synthesis gas, a pyrolysis product of coal, carbon dioxide, hydrogen sulfide and water (including steam).

As used herein, the term "fluid" refers to gases, liquids, and combinations of gases and liquids, as well as to combinations of gases and solids, combinations of liquids and solids, and combinations of gases, liquids, and solids.

As used herein, the term "wellbore fluids" means water, mud, hydrocarbon fluids, formation fluids, or any other fluids that may be within a string of drill pipe during a drilling operation.

As used herein, the term "gas" refers to a fluid that is in its vapor phase at 1 atm and 15° C.

As used herein, the term "subsurface" refers to geologic strata occurring below the earth's surface.

As used herein, the term "formation" refers to any definable subsurface region regardless of size. The formation may contain one or more hydrocarbon-containing layers, one or more non-hydrocarbon containing layers, an overburden, and/or an underburden of any geologic formation. A formation can refer to a single set of related geologic strata of a specific rock type, or to a set of geologic strata of different rock types that contribute to or are encountered in, for example, without limitation, (i) the creation, generation and/or entrapment of hydrocarbons or minerals, and (ii) the execution of processes used to extract hydrocarbons or minerals from the subsurface.

As used herein, the term "wellbore" refers to a hole in the subsurface made by drilling or insertion of a conduit into the subsurface. A wellbore may have a substantially circular cross section, or other cross-sectional shapes. The term "well," when referring to an opening in the formation, may be used interchangeably with the term "wellbore." The term "bore" refers to the diametric opening formed in the subsurface by the drilling process. (Note that this is in contrast to the term "cylinder bore" which may be used herein, and which refers to a hydraulic cylinder over a wellbore.)

Description of Selected Specific Embodiments

Figure 1A:
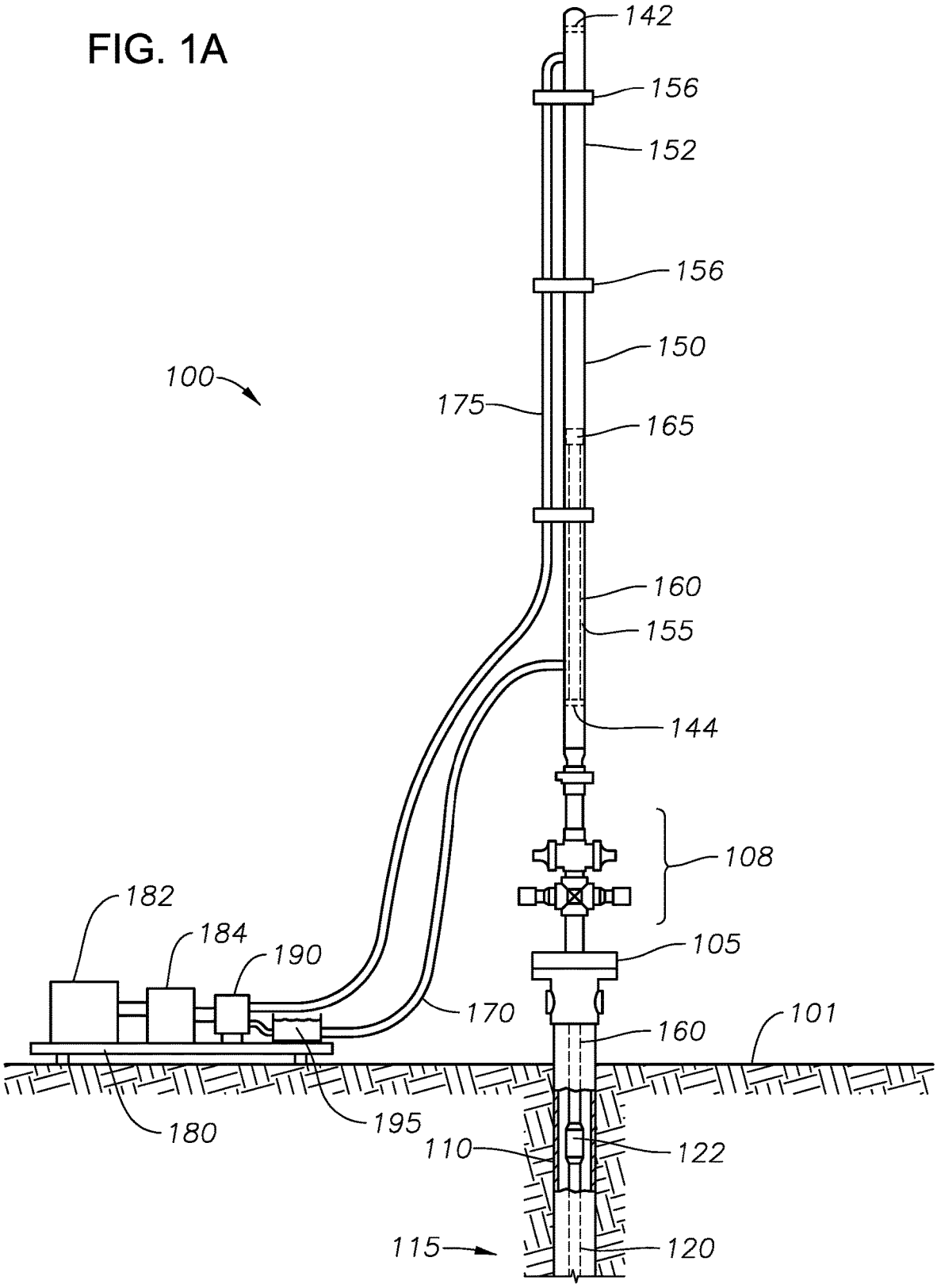
FIG. 1A is a side view of a hydraulic oil well pumping system of the present invention, in one embodiment. The hydraulic oil well pumping system is used for producing reservoir fluids from a subsurface formation to the surface. Portions of the system are shown schematically.

FIG. 1A is a side view of a hydraulic oil well pumping system 100 of the present invention, in one embodiment. The hydraulic oil well pumping system 100 is used for producing reservoir fluids from a subsurface formation (not shown) to the surface 101. Portions of the system 100 are shown schematically.

In FIG. 1A, it is first seen that the system 100 includes an elongated cylinder 150. In this arrangement, the cylinder 150 resides over a wellhead 105. The wellhead 105 serves to support a string of production tubing 110 that extends from the surface 101 and down into a wellbore 115.

Above the wellhead 105 is a set of control valves. The valves are part of a "Christmas tree," shown at 108. The Christmas tree 108 generally supports the cylinder 150. The valves of the Christmas tree 108 direct the flow of production fluids and also permit an operator to inject treatment chemicals or otherwise access the production tubing 110.

Residing within the wellbore 115 is a rod string 120. The rod string 120 is comprised of a plurality of long, slender joints of steel, known as sucker rods. Each sucker rod is typically 25 or 30 feet in length. The rod string 120 supports a pump (not shown) downhole. The pump, in turn, moves production fluids from the subsurface formation, up the production tubing 110, and to the wellhead 105 through positive displacement. The pump is generally positioned next to a perforated zone of the wellbore 115. The production fluids then flow out of a valve in the Christmas tree 108 where they may undergo some initial fluid separation and are then directed into a flow line or a gathering tank (not shown).

Each sucker rod includes a coupling. In FIG. 1A, a coupling 122 is shown above the rod string 120. In this view, the coupling 122 connects the rod string 120 to a polished rod 160. The polished rod 160, in turn, extends up through the wellhead 105, through the Christmas tree 108, and into the cylinder 150. The polished rod 160 defines an elongated cylindrical body.

At an upper end of the polished rod 160 is a piston 165. The piston 165 seals an annular area 155 formed between the polished rod 160 and the surrounding cylinder 150. The piston 165 prevents the hydraulic oil from migrating into a chamber above the piston 165. The annular area 155 is filled with a working fluid, typically a clean hydraulic oil.

The piston 165 and connected polished rod 160 reciprocate within the cylinder 150 between two heads. A first or upper head 142 is at a distal end of the cylinder 150, while a second or lower head 144 is at a proximal end of the cylinder 150. The second head 144 has an internal bore to slidably receive the polished rod 160.

The hydraulic oil well pumping system 100 also includes a pair of fluid lines 170, 175. A first fluid line 170 is an oil line. The oil line 170 is in fluid communication with the annular area 155 of the cylinder 150 just above the second (or lower) head 144. The oil line 170 injects and receives oil from the annular area 155 in order to move the piston 160 up and down within the cylinder 150. In this way, an up stroke and a downstroke are created for the piston 165 and mechanically connected rod string 120 and downhole pump.

The second fluid line 175 is essentially a vent line. The vent line 175 receives air and any leaked oil from the piston 165 during the upstroke. The vent line 175 is supported by one or more brackets 156 disposed along the outer wall of the cylinder 150.

Figure 1B:
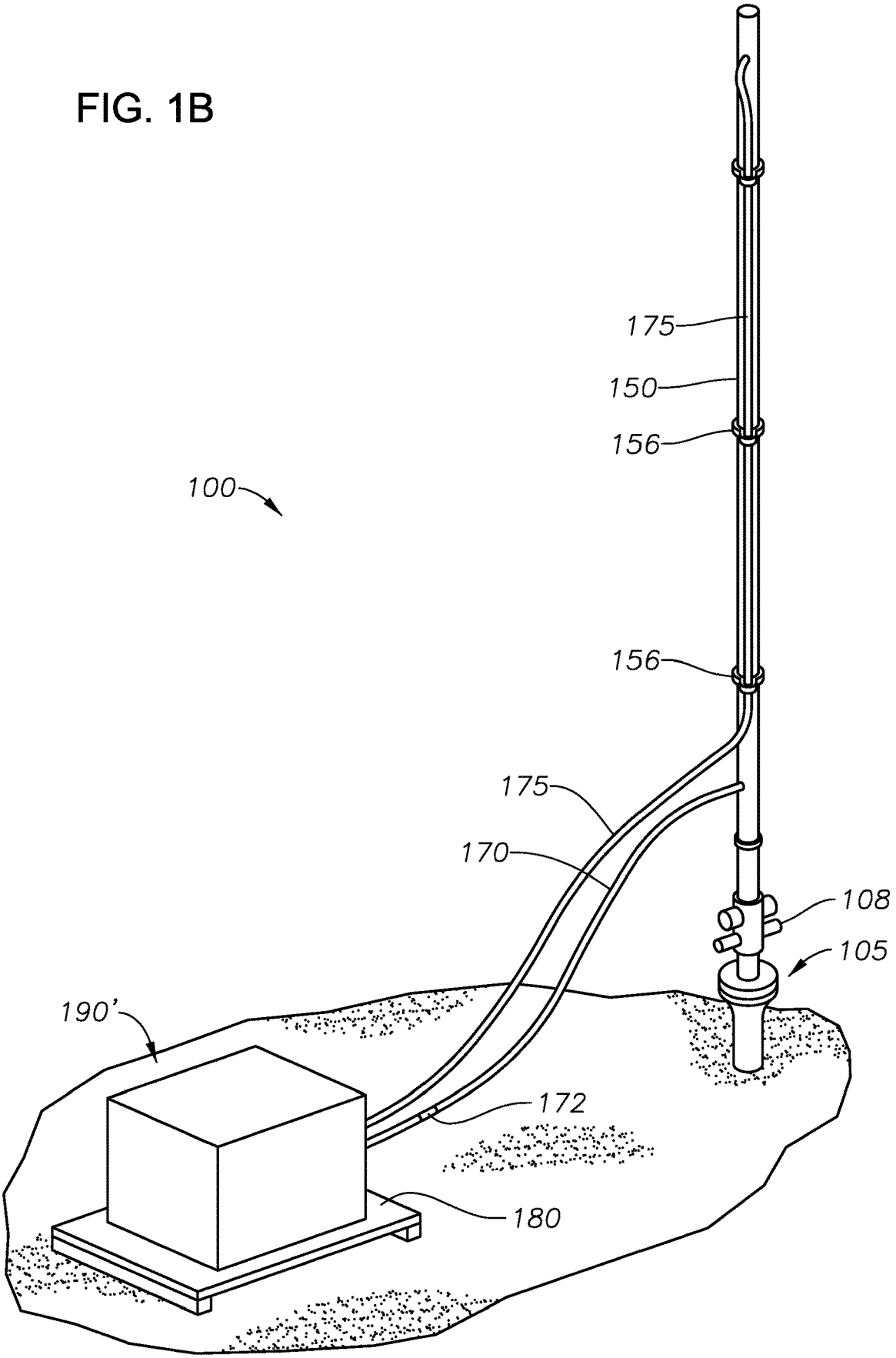
FIG. 1B is a perspective engineering view of a portion of the hydraulic oil well pumping system of FIG. 1A. Here, the cylinder is seen over the wellhead. The reservoir and the valving are also shown in an integral tank.

FIG. 1B is a perspective view of a portion of the hydraulic oil well pumping system 100 of FIG. 1A. Here, the cylinder 150 is seen over the wellhead 105. The two fluid lines 170, 175 are seen along with the supporting brackets 156.

Returning to FIG. 1A, additional components of the hydraulic oil well pumping system 100 are shown schematically. These include a prime mover 182, a hydraulic pump 184, a valve stack 190, and a fluid reservoir 195. These components are optionally supported together on a skid 180.

The prime mover 182 provides power to the pump 184. The prime mover 182 may be a gasoline engine, a diesel engine, or other internal combustion engine. Such a prime mover is shown at 482A in FIG. 4A and is discussed more fully below. Alternatively, the prime mover 182 may be an electric motor as shown at 482B in FIG. 4B and discussed below. When the prime mover 182 is started, it activates the hydraulic pump 184. Beneficially, changing the operating speed of the prime mover 182 will vary the output of the pump 184. Alternatively, different types of controlled valving can be used to vary the hydraulic output with a fixed RPM in the pump.

The pump 184 serves to pump fluid into the oil line 170. The pump 184 is preferably a vane style pump. However, other types of pumps such as a piston-type pump may be employed. The pump 184 may be a fixed displacement pump or a variable displacement pump.

Oil is directed from the pump 184 and into the oil line 170 by means of a set of valves 190. The valves 190 preferably include a discrete four-way valve. Such a valve is shown in detail at 500 in FIG. 5 as part of a valve stack. Alternatively, the valves 190 may include a proportional valve or even a variable speed prime mover as the valve.

In one preferred embodiment, the valves 190 are discrete valves housed together with the reservoir 195 in a dual-chambered tank. Such a tank is shown generally at 190' in FIG. 1B. The tank is shown in greater detail in FIGS. 4A and 4B.

Figure 2A:
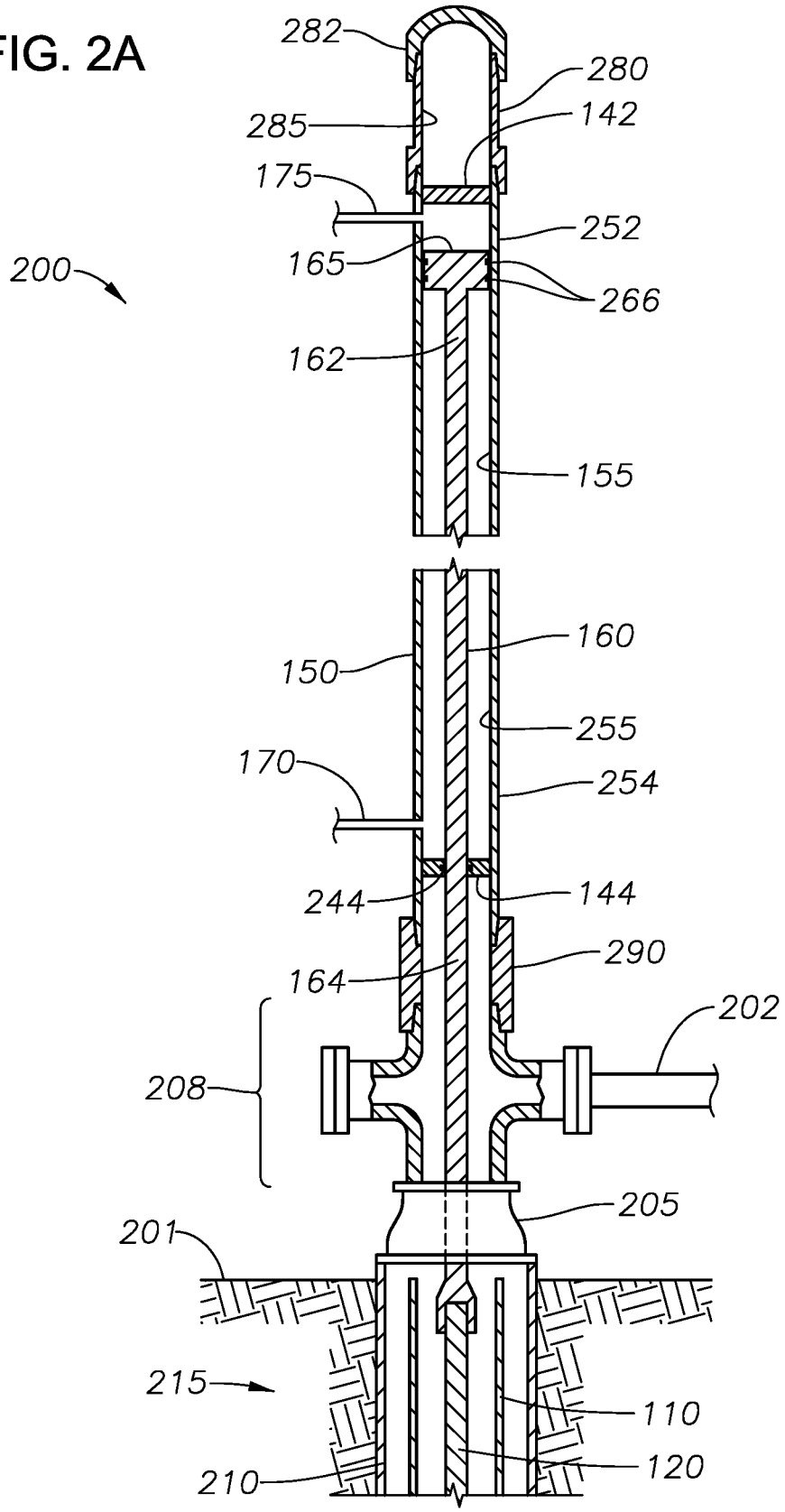
FIG. 2A is a cross-sectional view of the hydraulic cylinder of FIG. 1A in an enlarged view. The cylinder is again positioned above a wellhead and has a hydraulically actuated piston therein.
Figure 2B:
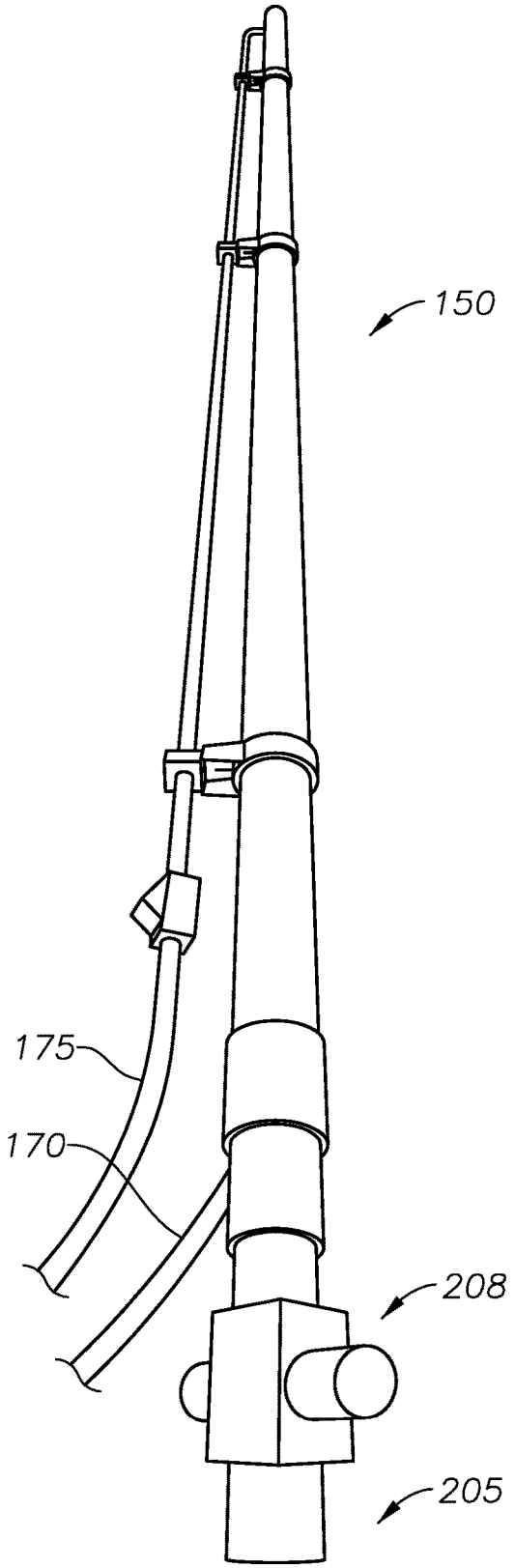
FIG. 2B is a perspective view of the hydraulic cylinder of FIG. 1A, in one embodiment.

Moving now to FIGS. 2A and 2B, FIG. 2A is a cross-sectional view of the hydraulic cylinder 150 of FIG. 1A, shown in an enlarged view. FIG. 2B is a perspective (photographic) view of the hydraulic cylinder 150 of FIG. 2A, in one embodiment.

Referring primarily to FIG. 2A, the hydraulic cylinder 150 is again seen residing over a wellhead 205 and a Christmas tree 208. The wellhead 205 and the Christmas tree 208 are shown somewhat schematically. The cylinder 150 is secured to the Christmas tree 208 and connected wellhead 205 by means of a coupling 290. The wellhead 205, in turn, is secured over a wellbore 215.

The wellbore 215 is formed by a string of casing 210. Within the casing 210 is the string of production tubing 110. The production tubing 110, in turn, holds the rod string 120 and receives production fluids.

At a top of the cylinder 150 is a threaded connector 280. The threaded connector 280 is optionally used to pick up the cylinder 150 during installation over the wellhead 205. The connector 280 is part of the upper head 142.

In some embodiments, a frame or a tripod (not shown) are used to stabilize the cylinder 150 over the wellhead 205. This optional feature is most commonly used in windy locations.

In FIG. 2A, the oil line 170 is seen entering the annular area 155 above the lower head 144. Further, the vent line 175 is seen in fluid communication with the annular area 155 below the upper head 142. In addition, the piston 160 is seen residing within the cylinder 150, forming the annular area 155.

The polished rod 160 has a distal end 162 and a proximal end 164. The distal end 162 connects to the piston 165. In FIG. 2A, one or more steel or composite rings 266 can be seen along the piston 165, providing the needed seal to keep hydraulic oil within the annular area 155. In addition, a seal 244 comprised of "Vee" packing or other material is preferably provided along the lower head 144 to provide fluid sealing along the polished rod 160.

The cylinder 150 shown in FIGS. 1A and 1B and FIGS. 2A and 2B reside above the wellhead 105, 205. However, it is possible to place the cylinder (and housed piston) inside the wellbore and below the wellhead. This may be of benefit on offshore production platforms where vertical height is a concern.

Figure 3:
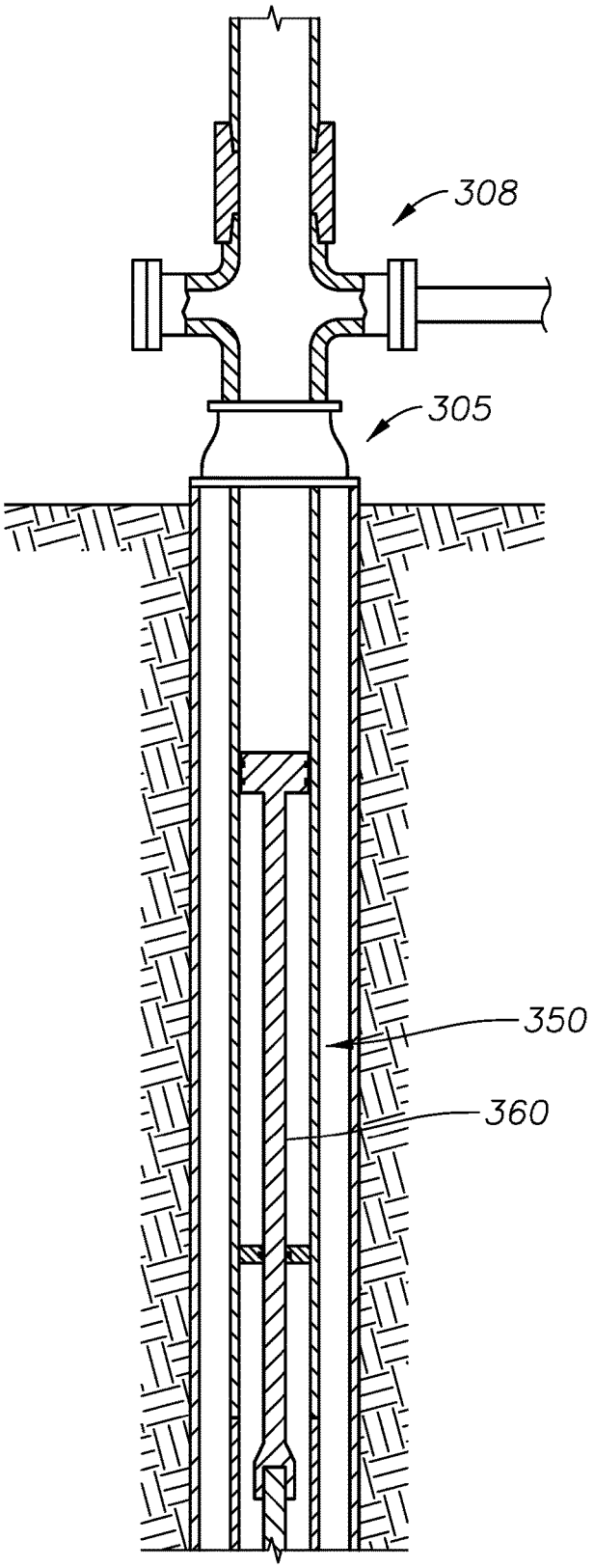
FIG. 3 is an engineering model showing a side, cut-away view of a cylinder having a hydraulically actuated piston therein. Here, the cylinder is disposed below the wellhead, inside the wellbore.

FIG. 3 is an engineering model showing a side, cut-away view of a cylinder 350 having a hydraulically actuated piston 360 therein. Here, the cylinder 350 is disposed below a Christmas tree 308 and a wellhead 305. Of interest, a vent line (not shown) comes directly out of the upper head (as in the above ground cylinder). The oil line also goes into the upper head, but is directed down through a double walled cylinder to the lower head.

Moving now to FIGS. 4A and 4B, each of FIGS. 4A and 4B presents certain components of the hydraulic oil well pumping system 100 of FIG. 1A. These components are supported on the skid 180. First, each figure shows a unique dual-chamber tank 490. Working oil is housed in a lower chamber 495, while valves and hoses are housed in an upper chamber 492. A lid 494 is provided over the upper chamber 492.

The valves are not clearly seen in FIGS. 4A and 4B; however, FIG. 5 shows an exploded view of the valves, or valve stack 500. The valve stack 500 generally includes a valve body 510, a downstroke control valve 520, and a sub-plate manifold 530. These components work together to form a four-way valve that allows hydraulic oil to be pumped from the pump 184 to the annular area 155 through oil line 170. The four-way arrangement also allows the operation and control of two wells stroking alternately.

As another feature, the valve stack 500 permits oil to return to the fluid reservoir chamber 495 via a restricted orifice. In this arrangement, the restricted orifice is referred to as a downstroke control valve, shown at 520. Oil returns to the fluid reservoir chamber 495 through the downstroke control valve 520 in response to gravitational forces applied to the piston 160 by means of the rod string 120 and connected downhole pump.

In FIG. 5, various components of the valve stack 500 are shown in perspective view. First, the valve body 510 is seen.

The valve body 510 serves as the directional control valve, which controls fluid flow during the upstroke. A pair of four-way valve end caps 512 are placed at either end of the valve body 510. The end caps 512 are secured in place via a plurality of head cap screws 513. O-rings 517 are seen placed between the end caps 512 and the valve body 510 to prevent oil leakage. These end caps 512 also allow for the insertion of a four-way spool 590, discussed below.

The valve body 510 includes additional components. These include a four way valve spring 514, studs 515, and insert nuts 516. The studs 515 and insert nuts 516 are used to connect the valve body 510 to the downstroke control valve 520 and the sub-plate 530. The valve spring 514 serves the purpose of returning the four-way spool 590 to a neutral position in the absence of an explicit control signal.

The downstroke control valve 520 represents an essentially rectangular block that is located between the sub-plate manifold 530 and the valve body 510. The downstroke control valve 520 has various passages allowing unrestricted flow in one direction (the upstroke direction), and restricted flow in the other direction (the downstroke direction). The downstroke control valve 520 includes a pair of valve cartridges 522. The cartridges 522 are mechanically adjustable to restrict the return flow during a downstroke. In this way, the cartridges 522 serve as restricted orifices to limit the return flow of hydraulic fluid, e.g., a refined oil or a clean aqueous fluid, from the cylinder during a downstroke. One cartridge 522 may control one well ("Well A"), while another cartridge 522 limits the rate of flow of oil from the cylinder of another well ("Well B").

As noted, the valve stack 500 also includes a sub-plate 530. The sub-plate 530 represents a rectangular block having various openings. These openings receive hydraulic pressure from the high-pressure discharge of the hydraulic pump The openings also interface the hydraulic lines 170, 175 that are in fluid communication with the cylinder. The openings further interface with various ports on the rest of the valve stack 500, starting with the downstroke control valve 520.

In the arrangement of FIG. 5, the sub-plate 530 receives a high pressure bypass cartridge 532 at one end. The cartridge 532 serves the purpose of limiting pressure delivered to the valve stack 500 and to the cylinder via line 170. Under normal operating conditions, the high pressure bypass cartridge 532 should not activate—it is merely a safety precaution if, for example, the valve stack 500 is compromised by a foreign object.

It is also seen that the sub-plate 530 has four ports 534. The oil line 170 comes in at two of the ports 534—one for one well ("Well A") and one for another well ("Well B"). In addition, the vent line 175 exits at two of the ports 534—one for one well ("Well A") and one for another well ("Well B"). The sub-plate 530 also includes head cap screws 535. The head cap screws 535 mechanically secure components of the valve stack 500 together as a unitary tool.

Other parts of the valve stack 500 are also seen in FIG. 5. These include an optional soft shift body 540 with an opposing pair of soft shift cartridges 542. When used, the soft shift cartridges 542 serve the purpose of reducing shock while shifting the four-way valve 510.

A pilot valve 550 is also provided. The pilot valve 550 receives an opposing pair of pilot solenoid coils 552. Further, the pilot valve 550 has a body seal plate 554. The pilot valve 550 utilizes a small and manageable amount of hydraulic fluid, controlled by the solenoid coils 552, to shift the much larger four-way valve 510. Pilot pressure is directed from the pilot valve 550 to the valve body 510 to shift the spool 590. This pilot pressure acts on either end of the spool 590 and against the end caps 512 to force the spool 590 and to shift the valve position. Once the spool 590 is shifted, the main hydraulic flow path through the valve body 510 is redirected.

An alignment plate 545 is seen between the soft shift body 540 and the pilot valve 550. The alignment plate 545 receives a plurality of screws 555, and insures alignment of the soft shift body 540 and the pilot valve 550.

Returning to FIGS. 4A and 4B, the dual-chamber tank 490 presents a unique arrangement for the valve stack 500 and a fluid reservoir. Because the valve stack 500 resides in the upper chamber 492 over the fluid reservoir, any nuisance leaks from the valve stack 500 will drip into the lower chamber 495. At the same time, because the valve stack 500 is isolated from the hydraulic oil in the lower chamber 495, the electronics need not be explosion-proof.

As an additional feature, the dual-chamber tank 490 employs a pair of inhale and exhale lines (not shown). The inhale and exhale lines create something of a bellows approach to pump fresh air into the tank 490 and to purge the air and potentially explosive gas from the fluid reservoir chamber 490 by way of the fluctuating fluid level. Because the hydraulic cylinder 150 mounts directly in the production line, that is, over the wellhead 105, there is a possibility of migrating gas from the wellbore 115 to the hydraulic oil reservoir chamber 495 via seal 244.

In operation, the hydraulic fluid level will rise and fall in the reservoir chamber 495 on each stroke of the piston 160. Two check valves are placed in the bulkhead (not shown) separating the upper 492 and lower 495 chambers. One check valve allows air (and residual oil drips) to flow from the upper chamber 492 in to the lower chamber; the other check valve allows air from the lower (fluid reservoir) chamber 495 to be safely vented outside the cabinet 490. Optionally, a vent line (not shown) may be run from the upper chamber 492, where applicable, to the outside of a building or other enclosure. In this way, the fluctuating hydraulic fluid level is used to "pump" fresh air from the upper chamber 492, through the lower reservoir chamber 495, and then safely directed outside.

As noted above, each of FIGS. 4A and 4B show a prime mover. The prime mover is designed to provide working power to a pump (seen at 184 in FIG. 1). In FIG. 4A, the prime mover 482A is shown as an internal combustion engine 482A. In FIG. 4B, the prime mover 482B is shown as an electric motor.

Also seen in each of FIGS. 4A and 4B is an electronics cabinet 484A, 484B. The illustrative cabinets 484A, 484B present two separate chambers—one for 480 volt AC motor controls, and one for programmable logic controller (low voltage) wiring. In the case of electronics cabinet 484A (for the gasoline engine), the cabinet 484A may optionally have only one box.

FIG. 6 is an engineering diagram showing illustrative hydraulic circuitry 600 of the hydraulic oil well pumping system 100 of FIG. 1, in one embodiment. Fluid lines and certain components for the system 100 are shown schematically.

First, a motor is shown at 682. The motor 682 is an electric motor that serves as a prime mover for powering a pump. It is understood that the prime mover may alternatively be an internal combustion engine. Alternatively, the motor 682 may utilize pneumatic cylinders, weight or gravity-driven cylinders, mechanical spring-driven cylinders or other source of fluid power.

Next, a hydraulic pump is shown at 684. The illustrative pump 684 is a vane pump. However, it is understood that the pump 684 may be any type of fixed or variable displacement hydraulic pump. The hydraulic discharge of the vane pump 684 is directed under the control of a programmable logic controller, either to the cylinder 155 or back to the tank 490.

The pump 684 pumps a working fluid such as a clean or refined oil from a reservoir 695. The reservoir may be, for example, the lower chamber 495 of FIGS. 4A and 4B. A line 686 is shown pulling oil from the reservoir 695 into the pump 684. The oil is then delivered through line 672 and then to lines 670 to a pair of wells 615A, 615B.

Each well 615A, 615B employs a hydraulic cylinder 650. Each cylinder 650, in turn, has a piston 665 and polished rod 660 that together reciprocate in response to fluid pressure applied by the cyclic injection of oil through lines 670. An annular area 655 is formed below the piston 660 and between the polished rod 660 and surrounding cylinders 650. Each piston 665 has a piston ring (seen in FIG. 2A at 266) that provides a seal for holding fluid pressure within the cylinders 650. The cylinders 650 are illustrative of cylinder 150 described above, while the oil lines 670 are representative of oil lines 170 from FIGS. 1A and 2A.

En route to the cylinders 650, the oil will travel through a directional control valve 692. The control valve 692 may be, for example, the discrete four-way valve stack 500 of FIG. 5. Alternatively, the control valve 692 may be a proportional valve or may be part of a variable speed prime mover. In any embodiment, the control valve 692 allows hydraulic oil to be pumped from the pump 684 to the annular area 655 through oil line 670. Pumping is controlled by a programmable logic controller (not shown).

The hydraulic circuitry 600 also includes a downstroke control valve 694. The down stroke control valve 694 may be part of the discrete valve stack 500 of FIG. 5. To this end, the directional control valve 692 and the downstroke control valve 694 are shown in FIG. 6 by a common bracket at 690. The down stroke control valve 694 permits oil to return to the fluid reservoir 695 via a restricted orifice, and then through reservoir line 688. This takes place when the directional control valve 692 is in its "neutral" position. Since pressure no longer forces the piston 660 upwardly, it begins to drop in response to gravitational forces applied to the pistons 660 by means of the rod string 120 and connected downhole pump.

Several additional components are seen in FIG. 6 as part of the hydraulic circuitry 600. These include a vent line 675, a heat exchanger 676, and an oil filter 678. The vent line 675 is comparable to line 175 of FIGS. 1A and 2A. The heat exchanger 676 is, preferably, an air-over-oil heat exchanger that utilizes a fan for cooling oil. The oil filter 678 filters return oil before it is deposited into the reservoir 695. A 25 psi bypass valve may optionally be provided so that excess pressure is not applied to the filter media in the filter 678. The four-way valve 692 or the bypass valve 673 directs return oil through the heat exchanger 676 and filter 678.

It is again noted that the hydraulic circuitry 600 of FIG. 6 shows two different cylinders 650 in two different wells 615A, 615B. The valve stack 690 is capable of driving two different wells concurrently, provided the requirements of the two wells are similar. The system can only operate one upstroke at a time, but can operate two wells alternating upstrokes. While one well 615A is upstroking, the other well 615B is downstroking. However, the valve stack 690 may be used to drive a piston 660 in only a single well should the operator so choose. Operating two wells is a capability, not a requirement.

In either design, it is desirable for the operator to know where the piston 665 is within the cylinder 650 during any given part of the cycle. One reason is so that speed control may be applied to the pump 684. Specifically, the operator may wish to decrease the speed of the pump 684, and thus decelerate the piston 665 and rod string at the ends of the upstrokes and downstrokes.

As noted above, hydraulically actuated reciprocating sucker rod pump systems have historically employed sensors along the wellhead. The sensors may be mechanical, hydro-mechanical, pneumatic, pneumatic-mechanical, acoustic, electronic or electro-mechanical position indicating devices to detect the position of the piston. For example, U.S. Pat. No. 7,762,321 teaches the use of a plurality of "proximity switches" along the actuation cylinder to detect the location of an object along the piston. When a proximity switch detects the object, a limit switch is activated that de-energizes a valve. Sensors have also been used to detect travel speed or direction and are used to control piston position, speed or direction.

Position feedback on hydraulically actuated rod pumping systems has been required to intelligently react to, control, monitor, or record the effects of dynamic load changes to the bottom-hole equipment. For example, it is known to mount the cylinder above the wellhead with the cylinder's rod exposed to the atmosphere for attachment of position indicating devices or linear position transducers. However, it is desirable to employ a simplified system that does not require the presence of sensors at or above the wellhead. Placing exposed electrical components in such an environment is undesirable. Furthermore, the wellhead is an area that sees much activity during well work and the small sensor components and cabling could be easily damaged. Thus, it is proposed herein to employ a rod pumping system and method that mathematically infer the piston position from a remote location. This is done by measuring cumulative or volumetric flow of the hydraulic working fluid into and out of the cylinder.

In connection with a hydraulic oil well pumping system, it is possible to use the hydraulic pressure in the annular area 155 to measure load on the piston 160. Generally, hydraulic pressure may be calculated as:

$$L=F\times A$$

where: L=load on the piston (pounds);
F=Force against the piston (psi); and
A=Annular area ($in^2$).

However, it is believed by the inventors herein that hydraulic fluid dynamics, in addition to the load calculation, may also be used to determine the relative position of the piston 165 within the cylinder 150. This may be done by measuring the total fluid volume or flow rate of fluid going into, and returning from, the annular area 155 of the hydraulic cylinder 150 during the upstroke and the down stroke. The position of the piston 165 within the cylinder 150 is then inferred from the volumetric measurements, all at a safe distance from the wellhead 105.

Various techniques may be employed for measuring fluid flow. In one aspect, differential pressure measurements may be used to measure the flow rate of hydraulic fluid. A cumulative series of flow rate measurements over a known cross-sectional area is equivalent to a total fluid volume over that time period. The pressure measurements are made at the valve stack 500 and not at the wellhead 105 or cylinder 150. Preferably, pressure sensors and transmitters (shown together at 536) are located along the sub-plate 530, but could be placed anywhere along the main hydraulic (or oil) line 170 as well.

In another aspect, a flow meter such as a paddle wheel 172 may be used. A paddle wheel has a shaft that is turned in response to hydraulic forces on a paddle. A correlation can be made between the number of rotations of the shaft at or near the valve stack 500 during a given period of time and a volume of fluid that passes across the paddle wheel during that time period. Of course, the present system and methods are not limited to the technique used for measuring volumetric flow unless expressly stated in the claims.

Next, the volume of the annular area is calculated:

$$V_A = L_S \times A_A$$

where: $V_A$=Volume of the annular area (gallons);
$L_S$=Stroke length of the piston (inches); and
$A_A$=Annular area [Cylinder area−piston area] ($in^2$)

From this, it is possible to calculate gallons of fluid pumped per stroke inch:

$$F = V_A / L_s$$

where: F=Fluid pumped (gallons per stroke inch);
$V_A$=Volume of the annular area (gallons); and
$L_S$=Stroke length of the piston (inches).

By way of example, assume the effective volume of the cylinder (the annular area 155 under the piston 165) is 10 gallons, and the stroke is 288 inches:

$$F = 10 \text{ gallons}/288 \text{ inches}$$
$$= 0.035 \text{ gallons/stroke inch.}$$

In a pumping cycle, the volume of hydraulic oil pumped into a cylinder and the corresponding rod piston position are linearly related. Thus, F (gallons/stroke inch) is not dependent on the velocity at which the piston is traveling or the pump pressure applied. It is also noted that a fixed displacement pump offers a unique advantage in that it is known how long it takes to fill the annular area $V_a$. Thus, if the pump is pumping at 10 gallons/minute, the annular area $V_a$ will be filled in 10 minutes when $V_a$ is 10 gallons. Of course, the use of the fixed displacement pump is only of benefit on the upstroke. On the down stroke, the velocity of the piston will be dependent on the free-fall of the piston 160 and the size of the restricted orifice in the downstroke control valve 520 or 694. Therefore, the calculations concerning F are critical to knowing the position of the piston 160 on the down stroke.

Another advantage to the present method is that no sensors are needed at the wellhead to determine piston location. Downhole well conditions may be monitored remotely by combining the cylinder's piston load and position without attaching devices on or near the wellhead. This enables remote monitoring and control of the cylinder's position, load and acceleration, while remotely monitoring the effects of the downhole dynamics on the fluid power system.

It is noted that diagnosis of a rod-pumped well based upon surface parameters was first presented by Gibbs in U.S. Pat. No. 3,343,409. Surface load and piston position are measured at consistent time intervals during the complete stroke cycle at the surface. The dynamics of the rod string and fluid are known, and from these pieces of information, it is possible to calculate the downhole load and position. This is a known procedure. However, this procedure requires that the operator or system know both the load and position of the polished rod at the surface. This further requires directly attached pressure and load sensors in the wellhead environment. It should be noted that directly attached sensors may not be used in the configuration where the hydraulic cylinder is placed inside the wellbore and submerged in crude oil.

The operator may wish to monitor hydraulic fluid pressure during the upstroke. For example, a pressure limit switch may be employed to cut off the pump in the event pressure spikes above a certain value. This is a safety feature that comes into play if, for example, the pump becomes stuck downhole. If excess pressure is detected along oil line 672, a relieve valve 673 may be used to release oil from line 672.

In one aspect, the absolute volume value ($V_A$) is not required; rather, a relative volume, or flow rate, value may be used. Using a measurement of fluid volume pumped, the operator can correlate the amount of fluid volume injected into a cylinder (annular area 155) to push the piston to the top of its stroke length and the position of the piston ring. Thus, for example, if a cylinder (annular area 155) has received 10 gallons for a full stroke length, then the operator knows that the piston is half way up the cylinder (144 inches) when 5 gallons have been pumped into the annular area 155. This relation between position and volume within the cylinder is linear. This also assumes little to no piston ring leakage during the stroke. If there is piston ring leakage, that oil is recovered through the vent line 175. This limits the effect of any consistent piston ring leakage to individual strokes; the effects are not cumulative.

FIG. 7 is a flow chart showing steps that may be performed for a method 700 of pumping oil from a wellbore, in one embodiment. The wellbore has a bore extending into an earth surface. The method 700 employs the unique pumping system described above, including the set of valves shown in FIG. 5 that are controlled by an electrical control system. The valves cyclically direct hydraulic fluid into a cylinder. The pressure created by the hydraulic fluid causes a piston and connected rod string and downhole pump to reciprocate. This, in turn, causes reservoir fluids to be produced from a wellbore to the surface through positive displacement.

Referring to FIG. 7, the method 700 first comprises providing an elongated hydraulic cylinder. This is shown at Box 710. The cylinder is positioned over the wellbore. The cylinder may either be over an associated wellhead as shown in FIG. 2A, or inside the wellbore below the wellhead as shown in FIG. 3.

The method 700 also includes providing a piston. This step is provided at Box 715. The piston may be in accordance with the piston 165 of FIG. 1A. The piston is movable between upper and lower rod positions within the cylinder. The piston creates an annular seal below the piston between a connected polished rod and the surrounding cylinder. Hydraulic pressure acts against the piston.

The method 700 further includes mechanically connecting the piston to a rod string, such as through a threaded coupling. This may be done through a polished rod between the piston and the rod string. When the piston reciprocates, the polished rod and connected rod string reciprocate with it. This is shown at Box 720. The rod string extends downwardly from the piston and into the wellbore. The rod string has a downhole pump connected to it for lifting fluids to the surface in response to reciprocation of the rod string.

The method 700 also includes providing a hydraulic pump. This is seen at Box 725. Preferably, the pump is a fixed displacement pump. The pump is powered by a prime mover. The prime mover may be an electric motor, an internal combustion engine, or other driver.

The method 700 also has the step of connecting the pump and the hydraulic cylinder with an oil line. This is indicated at Box 730. The oil line transmits hydraulic fluid from the pump to the cylinder.

Still further, the method 700 includes providing a directional control valve. This is given at Box 735. The directional control valve moves between upstroke and downstroke (neutral) flow positions in response to signals from an electrical control system. The electrical control system may be, for example, a programmable logic controller. When the valve is in its open position, it directs hydraulic fluid such as oil from the pump, through the oil line and into an annular area formed between the piston and the surrounding cylinder. In the neutral position, the control valve allows oil to flow back from the cylinder to the reservoir through a downstroke control valve.

It is understood that the downstroke control valve need not be a discrete valve. The downstroke control valve may be a nitrogen accumulator or any other device that captures the energy from the gravitational fall of the piston and connected polished rod, rod string and downhole pump.

The method 700 also has the step of providing a fluid reservoir. This is shown at Box 740. The reservoir contains hydraulic fluid to be supplied to the pump.

The method 700 next includes providing a reservoir line. This is seen at Box 745. The reservoir line transmits hydraulic fluid from the cylinder to the reservoir. An example of a reservoir line is seen at line 688 of FIG. 6. Optionally, a filter is provided along the reservoir line. A filter is seen at 678 of FIG. 6.

The method 700 also has the step of providing a down stroke control valve. This is shown at Box 750 of FIG. 7. The down stroke control valve chokes the flow of fluid from the cylinder back to the reservoir. This, in turn, limits the rate of flow of hydraulic fluid. An example of a down stroke control valve is shown schematically at 694 in FIG. 6.

The method 700 also offers the step of controlling movement of the piston as it moves between upper and lower rod positions. This step is provided at Box 755. The step of Box 755 is done by using an electronic control system. The control system controls the valves and the pump to cycle the pump between (i) an "upstroke" condition wherein the pump is pumping oil through the control valve, through the oil line and into the hydraulic cylinder to move the piston to its upper rod position, and (ii) a "neutral" condition wherein the pump is no longer pumping oil into the hydraulic cylinder, but is allowing oil to flow back through the oil line in response to gravitational fall of the piston. The electronic control system is programmed to cycle based upon a volumetric calculation of hydraulic fluid in the cylinder and without reference to position sensors along the wellhead.

Preferably, and as noted above, the electronic control system controls movement of the rod based on (i) the volume, or rate, of hydraulic fluid sent to the cylinder during the "upstroke" valve condition, (ii) the volume, or rate, of hydraulic fluid returned from the cylinder during the "neutral" valve condition, or (iii) both. Optionally, the control system may send a signal to cause the pump to vary its output, to cause a valve to adjust its proportional flow, or to change an operating speed of the prime mover based upon either (i) a volume of fluid that has moved into the hydraulic cylinder during the "upstroke" valve condition, or (ii) a volume of fluid that has returned from the hydraulic cylinder during the "neutral" valve condition.

In one aspect, the electronic control system sends a signal to cause the valve to change flow paths and to initiate a down stroke of the piston based upon (i) a relative measurement of a volume, or rate, of fluid that has moved into the hydraulic cylinder, or (ii) an absolute volume of fluid that has moved into the hydraulic cylinder, during the "upstroke" valve condition. The measurement of fluid volume may be based upon (i) pressure differential across a fixed orifice, (ii) a flow meter such as a paddle wheel, or (iii) fluid level in the reservoir. Alternatively, some combination of these approaches, or other methods of measuring a moving fluid volume may be used.

Also, the method 700 includes reciprocating the piston and mechanically connected rod string in order to pump oil from the wellbore. This is indicated at Box 760. The step of Box 760 is the natural result of operation of the control system and pump over time.

It is noted that by taking volumetric measurements over time, the operator can plot the position of the piston during the strokes. In addition, velocities, and accelerations can be calculated. Using a programmable logic controller, the system may be controlled to operate at a constant speed during the upstroke of the piston. Further, the pump speed may be altered prior to and during changes of direction to reduce load on the rod string and connected pump. In this respect, the surface stroke velocity can be proactively altered to minimize the stress on the sucker rod string and pump. This can be done by controlling the pump speed, and by controlling the bleed-down rate for the relief line 675 through the down stroke control valve 694. This helps to reduce fatigue of the sucker rod string 120 and to minimize fluid or gas pounding effects upon the bottom hole pump.

In one aspect, the operator sets the cycle for the down stroke based on time. The operator estimates how long it takes the piston 660 to fall to the bottom of the cylinder 650. The pumping of hydraulic fluid is not resumed until a designated period of time for the down stroke has lapsed. By monitoring volume, or rate, of flow out of the cylinder 650, the system may make small adjustments or change valve states in order to minimize stress on the mechanical system.

FIGS. 8A and 8B are another flow chart. Here, steps are shown for a method 800 of determining the position of a piston within a hydraulic cylinder. The piston is a hydraulically actuated piston that resides within a cylinder. The cylinder, in turn, is positioned over a wellbore.

The method 800 first includes determining a volume of hydraulic fluid needed to fill the cylinder. In one aspect, the volume is an annular area below the piston and between a connected polished rod and a surrounding hydraulic cylinder. This is shown at Box 810.

The method 800 also includes determining a rate for filling the cylinder during the upstroke of the piston. This is provided at Box 820. The annular area is filled using a pump along with an oil line that provides fluid communication between the pump and the annular area. The rate at which the cylinder can be filled is a function of the hydraulic pump output and the speed at which that pump is driven.

The method 800 further has the step of determining a first time. This first time is the time it takes to fill the annular area (or cylinder) during the upstroke. This is seen at Box 830. The step of box 830 is based upon the determined volume and rate from the steps of Boxes 810 and 820. This provides a baseline to which subsequent strokes can be calibrated against. In general, the theoretical time to fill the cylinder is a minimum. Other factors such as degraded pump efficiencies or piston ring leakage may increase the time required to fill the cylinder.

The method 800 still further includes determining a second time. This second time is the time it takes to drain the fluid from the cylinder through a down stroke control valve.

This is shown at Box 840. The down stroke control valve has a restricted orifice for reducing or restricting a rate at which the piston falls during draining. The rate at which the downstroke occurs is not constant. Downhole loads fluctuate significantly depending on changing conditions, and as the loads shift during a downstroke, the rate at which fluid is allowed to pass through the orifice also changes. It is therefore critical to closely monitor both of these changing loads and position measurements to apply Gibbs' method for calculating the conditions during the full stroke cycle.

The method 800 also has the step of controlling movement of the piston as it reciprocates between upper and lower rod positions. This step is provided at Box 850. The step of Box 850 is done by using an electronic control system. The control system causes the pump to cycle between (i) an "upstroke" condition wherein the pump is pumping oil through the control valve, through the oil line and into the hydraulic cylinder to move the piston to its upper rod position over the first time, and (ii) a "neutral" condition wherein the pump is no longer pumping oil into the hydraulic cylinder, but is allowing oil to flow back through the oil line and through the down stroke control valve in response to gravitational fall of the piston over the second time. Of interest, the cycling is performed without reference to position sensors along the wellhead.

The method 800 further includes monitoring hydraulic fluid pressure in the oil line. This is shown at Box 860. The pressure is monitored during the first time and the second times. In one aspect, monitoring is conducted at regular intervals to correlate to the position samples.

The method 800 then includes reciprocating the piston and mechanically connected rod string in order to pump oil from the wellbore. This is provided at Box 870. In practical effect, the step of Box 870 is the result of the step of Box 850 over time.

In one aspect, the method 800 further includes calculating a position of the piston during the upstroke. This calculation is based upon (i) the relative volume, or rate, of hydraulic fluid injected by the pump during the "upstroke" condition, (ii) the absolute volume of fluid injected by the pump during the "upstroke" condition, or (iii) a full scale calibration from the ratio of a pressure reading in the oil line to a baseline pressure representing a pressure value just before the piston has reached a mechanical top of its upstroke. This is provided at Box 880. The method 800 may then include the step of sending a signal from the electronic control system to cause the pump to vary its output, to cause a valve to adjust its proportional flow, or to change an operating speed of the prime mover based upon the location of the piston during its upstroke. This is shown at Box 885.

In another aspect, the method 800 further includes calculating a position of the piston during the downstroke based upon (i) the relative volume, or rate, of hydraulic fluid drained from the hydraulic cylinder during the "neutral" condition, (ii) the absolute volume of hydraulic fluid drained from the hydraulic cylinder during the "neutral" condition, or (iii) when the pressure reading in the oil line has reached a value of substantially 0, indicating a mechanical bottom of the down stroke. This is provided at Box 890. When the piston noticeably hits the bottom of the stroke, the volumetric measurements can be reset, allowing each stroke to be measured independently without influence from previous strokes. The method 800 then includes the step of sending a signal from the electronic control system to cause the pump to vary its output, to cause a valve to adjust its proportional flow, or to change an operating speed of the prime mover based upon the location of the piston during its down stroke. This is shown at Box 895.

As can be seen, a method for measuring and controlling the position of the hydraulic piston in a linear stroking fluid power cylinder, used specifically for actuating a sucker rod string and bottom hole plunger pump in oil or gas wells is offered herein. The system and method provide the ability to remotely measure or control a piston's position, speed and direction in the absence of direct measurements of position and/or load at the wellhead.

Beneficially, the operator will be able to stop or slow the piston and connected rod string at various positions during the upstroke or downstroke. This allows the operator to run various down-hole valve tests. This is in addition to the slowing of the piston at the ends of the strokes to minimize mechanical stresses on the complete system.

Under one embodiment of the systems and methods described herein, differential pressure measurements taken at a given orifice (which corresponds to square of the fluid velocity through a give orifice) may be used to "calibrate" a system onto itself. Under such embodiment, there would be no need to account for certain parameters including location of pressure taps relative to fixed orifice, hydraulic fluid viscosity, oil temperature, orifice diameter, or even cylinder volume, etc, because all such factors may be corrected for in a calibration operation. Under this embodiment, it is known that the piston within a hydraulic system always starts from position zero, and that full stroke length can be periodically detected through a spike in hydraulic pressure. Although the goal is to prevent hitting the mechanical top of a piston upstroke on each stroke, such piston position may be periodically probed to perform the calibration operations described below. Data samples of differential pressure before and after a given orifice (and therefore data samples of fluid velocity through a give orifice) may be logged and scaled according to a percentage of the full stroke length. The known piston stroke length can be applied to this percentage to derive the unitized measurement of actual piston position. The process yields a calibration factor, which may be pro-actively used to determine real-time position of a piston on subsequent strokes, or between calibration cycles. Note that differential pressure measurements may be taken across a fixed orifice, or by other such flow rate measurement techniques, located at or near the valve stack or along an oil line to or from the cylinder, but embodiments are not so limited.

The calibration approach described above may be implemented using the following steps. assuming a data sampling rate of 10 ms:

- Calculate the square root of sampled differential pressure data (which corresponds to the fluid velocity through the orifice);
- Multiply that instantaneous fluid velocity data by a 10 ms sample interval and add result to a running total (a preferred method would be to use the trapezoidal rule to calculate the average velocity over this sample period);
- Assume System performs X units of velocity for 10 ms;
- Subsequent data samples sweep out the area under a velocity curve which is equivalent to position data of a piston (i.e. data samples capture information of a piston's position, velocity, and acceleration, as all three are related over time);
- At any given point, a running total register holds what amounts to a cumulative position reading of the piston; note that such values are scaled by a yet unknown factor (unknown until the end of stroke, where we can derive it from the stroke length);

Samples from the running total register (along with the piston load) may be read, and logged for later processing, from the register at a more reasonable sample rate than the high frequency data sampling rate; note that since differential pressure/velocity is being processing at a very high sample rate, the position value derived (or more accurately, integrated) from the velocity data at any given point should be nearly as precise as the inputs;

At the end of piston upstroke, the position value of the piston is assumed to be 100% of the stroke length which is to be mechanically calibrated/verified periodically by deadheading the piston;

Gathered position samples over the total stroke (logged from the high frequency, velocity over time, register) may then be scaled according to a calibration percentage/factor and known overall stroke length to yield actual piston position in inches.

The same procedure as described above starts over for the piston downstroke, which might have some different fluid dynamics in the return path; such difference should not matter since upstroke and downstroke are treated independently. Starting with an assumed top of piston stroke, as previously determined, bottom of stroke may be detected when the hydraulic pressure effectively drops to zero, meaning the piston is resting on the mechanical bottom of stroke.

Under this embodiment, a relatively simple sensor and method may be used to measure differential pressure across a given orifice. One does not need to know anything about certain parameters including location of pressure taps relative to fixed orifice, hydraulic fluid viscosity, oil temperature, orifice diameter, or even cylinder volume, etc, because they are more or less constants embedded in the "position" data. Those details all become irrelevant once end of the stroke is determined. These variable factors are all contained in a single calibration factor that, along with the stroke length, will scale the individually calculated position samples into familiar units such as inches. This process yields a calibration factor which may be pro-actively used to determine real-time position of the piston (and that scaling/calibration factor will most likely be different from upstroke to downstroke).

It is understood that the hydraulic oil well pumping system 100 of FIG. 1 and the method 700 for pumping oil of FIG. 7 are merely illustrative. Other arrangements may be employed in accordance with the claims set forth below. Further, variations of the method for determining position of the piston may fall within the spirit of the claims, below. It will be appreciated that the inventions are susceptible to modification, variation and change without departing from the spirit thereof.

We claim:

1. A method of determining a location of a hydraulically actuated piston within a cylinder disposed over a wellbore, comprising:

determining a volume of hydraulic fluid needed to fill a hydraulic cylinder during a piston upstroke;

measuring a dynamic rate for filling the cylinder during the upstroke using a pump, wherein an oil line provides fluid communication between the pump and the cylinder;

determining a first time for filling the cylinder during the upstroke;

determining a second time for draining the fluid from the cylinder through a down stroke control valve, the down stroke control valve having a sized orifice for restricting a rate at which the piston falls during draining;

using an electronic control system, controlling movement of the piston as it reciprocates between upper and lower rod positions within the hydraulic cylinder by cycling a directional control valve between (i) an "upstroke" condition wherein the pump is pumping oil through the directional control valve, through the oil line and into the hydraulic cylinder to move the piston to an upper rod position over at least the first time, and (ii) a "neutral" condition wherein the pump is no longer pumping oil into the hydraulic cylinder, but is allowing oil to flow back through the oil line and through the down stroke control valve in response to gravitational fall of the piston and an operatively connected rod string during the second time; and reciprocating the piston and operatively connected rod string in order to pump oil from the wellbore;

and wherein the electronic control system is programmed to:

receive pressure signals from a pressure sensor in fluid communication with the oil line during the first time and the second time;

calculate flow rates of the hydraulic fluid through the oil line based upon the pressure signals, and convert the calculated flow rates into volumetric measurements to determine a location of the piston in the hydraulic cylinder in real time, and confirm the location of the piston by comparing the pressure signals with a pre-calibrated log correlating fluid pressure with piston location, and without reference to position sensors along the wellhead;

adjust a position of a downstroke control valve to control a rate of descent of the piston within the cylinder when the directional control valve is in its neutral condition in response to determining the location of the piston within the cylinder; and change an operating speed of a prime mover associated with the pump in order to control a rate of ascent of the piston within the cylinder when the directional control valve is in its upstroke condition in response to determining the location of the piston and in response to changes in load on the rod string.

2. The method of claim 1, wherein:

hydraulic fluid volume moving into the cylinder during piston movement is further determined by (i) one or both of a relative volume and rate of hydraulic fluid injected by the pump into the cylinder during the "upstroke" condition, (ii) an absolute volume of fluid injected by the pump and into the cylinder during the "upstroke" condition, or (iii) a ratio of a pressure reading in the oil line to a baseline pressure representing a pressure value just before the piston has reached its upper rod position.

3. The method of claim 1, further comprising:

sending a signal from the electronic control system to cause the pump to vary its output, or to change an operating speed of the prime mover based upon the location of the piston within the hydraulic cylinder during the piston's upstroke; and sending a signal from a pressure cut-off switch to turn off the prime mover when a pressure reading along the oil line during a piston upstroke exceeds a designated limit.

4. The method of claim 1, wherein:

hydraulic fluid volume moving out of the cylinder during piston movement is determined by (i) one or both of a relative volume and rate of hydraulic fluid drained from the hydraulic cylinder during the "neutral" condition, (ii) the absolute volume of hydraulic fluid drained from the hydraulic cylinder during the "neutral" condition, or (iii) when the pressure reading in the oil line has reached a value of 0, indicating a mechanical bottom of the piston's down stroke.

5. The method of claim 4, further comprising:

sending a signal from the electronic control system to cause the pump to vary its output, to cause the down stroke control valve to adjust its proportional flow, or to change an operating speed of the prime mover based upon the location of the piston within the hydraulic cylinder during its down stroke.

6. A dynamometer card for a hydraulically actuated rod pumping system having a piston residing within a hydraulic cylinder, a rod string that moves with the piston, a directional control valve, a downstroke control valve and a cylinder dimensioned to contain the piston and hydraulic fluid, the dynamometer card comprising:

an "x"-axis representing a piston position within the cylinder; and a "y"-axis representing fluid load applied on a downhole pump during a pumping cycle; and wherein the rod pumping system further comprises:

a hydraulic pump that is powered by a prime mover;

an oil line fluidly connecting the pump and the cylinder, the directional control valve being positioned along the oil line to direct flow between the pump and the cylinder; and an electronic control system that controls movement of the piston as it moves between upper and lower piston positions by cycling the directional control valve between (i) an "upstroke" condition wherein the pump is pumping hydraulic fluid through the oil line and into the hydraulic cylinder to move the piston to its upper piston position, and (ii) a "neutral" condition wherein the pump is no longer pumping fluid into the hydraulic cylinder, but is allowing hydraulic fluid to flow back through the oil line in response to gravitational fall of the rod string and piston, wherein the piston moves to its lower piston position without reference to a position sensor located along an associated wellhead;

and wherein the electronic control system is programmed to:

calculate flow rates of the hydraulic fluid through the oil line based upon differential pressure signals along the oil line, and convert the calculated flow rates into volumetric measurements to determine a location of the piston in the hydraulic cylinder in real time;

adjust a position of the downstroke control valve to control a rate of descent of the piston within the cylinder when the directional control valve is in its neutral condition in response to determining the location of the piston within the cylinder;

reset the volumetric measurements to "0" when a pressure signal in the oil line has reached a value of substantially "0", indicating the piston is at a mechanical bottom of the down stroke; and change an operating speed of a prime mover associated with the pump in order to control a rate of ascent of the piston within the cylinder when the directional control valve is in its upstroke condition in response to determining the location of the piston and in response to changes in load on the rod string; and wherein the electronic control system is pre-calibrated to identify a top-of-stroke position, and various data samples correlating differential pressures with the top-of-stroke piston position that are loaded into the electronic control system.

7. The dynamometer card of claim 6, wherein the hydraulically actuated rod pumping system further comprises:

a fluid reservoir for containing hydraulic fluid to be supplied to the hydraulic pump.

8. The dynamometer card of claim 7, wherein the electronic control system is further configured to:

identify a bottom-of-stroke position of the piston based on a hydraulic fluid pressure reading of "0;"

identify a top-of-stroke position based on a spike in hydraulic pressure; and confirm the location of the piston between bottom-of-stroke and top-of-stroke by determining pressure of the hydraulic fluid as a percentage of top-of-stroke pressure.

9. The dynamometer card of claim 6, wherein the load on the rod string is calculated using hydraulic pressure and effective cylinder area.

10. The dynamometer card of claim 6, wherein the cylinder resides above a wellbore associated with the dynamometer card, or at an upper end of the wellbore.

11. The dynamometer card of claim 10, wherein the hydraulically actuated rod pumping system further comprises:

a vent line configured to return any oil that leaks past the piston back to a fluid reservoir or the oil line;

a pressure cut-off switch configured to send a signal to the electronic control system to turn off the prime mover when a pressure reading along the oil line during a piston upstroke exceeds a designated limit; and a filter placed along the vent line to filter the hydraulic fluid.

12. A method of determining a location of a hydraulically actuated piston within a cylinder disposed over a wellbore, comprising:

determining a volume of hydraulic fluid needed to fill a hydraulic cylinder during a piston upstroke;

determining a first minimum time for filling the cylinder during the upstroke, the minimum time serving as a baseline;

determining a second time for draining the fluid from the cylinder through a down stroke control valve, the down stroke control valve having a sized orifice for restricting a rate at which the piston falls during draining;

pre-calibrating an electronic control system by loading a log of differential pressure values correlated with piston position along the cylinder, such that differential pressures are scaled according to a percentage of a full piston stroke length;

using the electronic control system, controlling movement of the piston as it reciprocates between upper and lower rod positions within the hydraulic cylinder by cycling a directional control valve between (i) an "upstroke" condition wherein the pump is pumping hydraulic fluid through the directional control valve, through an oil line and into the hydraulic cylinder to move the piston to an upper rod position over at least the first minimum time, and (ii) a "neutral" condition wherein the pump is no longer pumping hydraulic fluid into the hydraulic cylinder, but is allowing hydraulic fluid to flow back through the oil line and through the down stroke control valve in response to gravitational fall of the piston and an operatively connected rod string during the second time;

providing a pressure cut-off switch configured to suspend operation of the pump when a pressure reading along the oil line during a piston upstroke exceeds a designated limit; and reciprocating the piston and operatively connected rod string in order to pump oil from the wellbore;

and wherein the electronic control system is programmed to:

monitor hydraulic fluid pressure in the oil line during the first minimum time and the second time, and receive pressure signals indicative of the fluid pressure;

compare the pressure signals with the pre-calibrated log in real time to determine a location of the piston along the hydraulic cylinder as a percentage of the full piston stroke length, and without reference to position sensors along the wellhead;

confirm that the first minimum time has taken place during each upstroke;

adjust a position of the downstroke control valve to control a rate of descent of the piston within the cylinder when the directional control valve is in its neutral condition in response to determining the location of the piston within the cylinder; and change an operating speed of a prime mover associated with the pump in order to control a rate of ascent of the piston within the cylinder when the directional control valve is in its upstroke condition in response to determining location of the piston and in response to changes in load on the rod string.

* * * * *